US006177383B1

(12) United States Patent
Amano et al.

(10) Patent No.: US 6,177,383 B1
(45) Date of Patent: Jan. 23, 2001

(54) REVERSIBLE THERMOSENSITIVE RECORDING MEDIUM, AND IMAGE FORMING AND ERASING METHOD

(75) Inventors: Tetsuya Amano, Numazu; Kazumi Suzuki, Shimizu-machi; Atsushi Kutami, Numazu; Yoshihiko Hotta, Mishima; Tsuyoshi Watanabe, Tokyo; Ryouji Furuta, Tokyo; Takashi Ukachi, Tokyo, all of (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/274,799

(22) Filed: Mar. 23, 1999

(30) Foreign Application Priority Data

Mar. 23, 1998 (JP) ..... 10-092230

(51) Int. Cl.[7] ..... B41M 5/40
(52) U.S. Cl. ..... 503/201; 503/200; 503/226
(58) Field of Search ..... 503/200, 201, 503/226

(56) References Cited

U.S. PATENT DOCUMENTS

| | | | |
|---|---|---|---|
| 5,017,421 | 5/1991 | Hotta et al. | 478/216 |
| 5,472,929 | 12/1995 | Inoue et al. | 503/204 |
| 5,643,851 | 7/1997 | Konagaya et al. | 503/201 |

FOREIGN PATENT DOCUMENTS

| | | |
|---|---|---|
| 535930A1 | 4/1993 | (EP) . |
| 710572A1 | 5/1996 | (EP) . |
| 54-119377 | 9/1979 | (JP) . |
| 55-154198 | 12/1980 | (JP) . |
| 62-055650 | 3/1987 | (JP) . |
| 63-14754 | 1/1988 | (JP) . |
| 63-39378 | 2/1988 | (JP) . |
| 63-130380 | 6/1988 | (JP) . |
| 63-191673 | 8/1988 | (JP) . |
| 63-315288 | 12/1988 | (JP) . |
| 6414079 | 1/1989 | (JP) . |
| 64-33781 | 2/1989 | (JP) . |
| 2188292 | 7/1990 | (JP) . |
| 2188293 | 7/1990 | (JP) . |
| 3-2089 | 1/1991 | (JP) . |
| 3007377 | 1/1991 | (JP) . |
| 2135418 | 5/1991 | (JP) . |
| 3130188 | 6/1991 | (JP) . |
| 3169590 | 7/1991 | (JP) . |
| 4224996 | 8/1992 | (JP) . |
| 4247985 | 9/1992 | (JP) . |
| 4267190 | 9/1992 | (JP) . |
| 9142037 | 6/1997 | (JP) . |
| 9-142037 * | 6/1997 | (JP) . |

* cited by examiner

*Primary Examiner*—Bruce H. Hess
(74) *Attorney, Agent, or Firm*—Cooper & Dunham LLP

(57) ABSTRACT

A reversible thermosensitive recording medium is provided, comprising a supporting substrate, a reversible thermosensitive recording layer and an overcoat layer, formed in the order recited, in which the recording layer changes transparency or color tone reversibly with temperature. The overcoat layer is formed to have a peak temperature of at most 155° C. in a tan δ vs. temperature curve, wherein tan δ is defined by G'/G", with dynamic modulus of elasticity represented by G' and dynamic elastic loss represented by G". This thermosensitive recording medium is capable of satisfactorily carrying out the formation and erasure of images with a heating device, such as a thermal printhead, and overcoming difficulties such as the occurrence of cracks and portions of the overcoat layer being removed therefrom and then sticking to heating elements of the thermal printhead, which are caused especially by the application of heating pulses for shorter periods of time and/or at increased pressures during repeated image formation and erasure processing.

24 Claims, 5 Drawing Sheets

REVERSIBLE THERMOSENSITIVE RECORDING MEDIUM, AND IMAGE FORMING AND ERASING METHOD

BACKGROUND

1. Field

The present invention relates generally to a reversible recording medium, and more particularly to a reversible thermosensitive recording medium capable of forming and erasing images repeatedly by utilizing a reversible change in transparency or in color of a thermosensitive layer with temperature.

2. Discussion of Background

A variety of information recording media have been developed to meet the demand for increasing volume and diversity of information. A reversible thermosensitive recording medium has been attracting much attention recently for its capability of forming and erasing images which can be carried out repeatedly on demand. In addition, such image forming and erasing may be achieved at relatively low cost without complicated developing steps.

Reversible thermal recording media are known to be capable of forming and erasing images by reversibly changing optical properties between two states such as, for example, an opaque state (image formed) and a transparent state (image erased), depending on temperature.

As representative examples of the reversible thermosensitive recording materials, there have been disclosed several recording materials such as a material including a nematic liquid crystal polymer material having an isotropic phase transition point higher than their glass transition temperature, capable of being reversibly erased by the application of light or heat, as described in Japanese Laid-Open Patent Application (referred to as "JPA", hereinafter) 63-191673 (1988); a film composed of a thermotropic liquid crystal polymer material in the choresteric phase, capable of being reversibly erased by the application of heat to thereby display transparent reversible color images, as described in JPA 2-135418 (1990); a dispersion in a crystalline matrix of both an electron-donating coloring agent having a lacton ring and an electron-accepting color developer having a phenolic hydroxy group, capable of being colored and erased reversibly by application of heat, as described in JPA 63-315288 (1988); a composition of both a leuco compound and its coloring or decoloring agent, capable of being colored or erased upon their reaction, as described in JPA 2-188293 (1990); a dispersion of low molecular weight organic materials such as higher alcohols or higher fatty acids which are included in a matrix resin such as polyester, capable of changing transparency reversibly depending on temperature to thereby record and erase information data, as described in JPA 54-119377 (1990) and 55-154198 (1991).

The known reversible thermosensitive recording media, however, have a shortcoming that portions of the recording layer may stick to a heating element, such as a thermal printhead, due to the large amount of friction therebetween. This causes the surface of the recording layer to become rough and to have approximately periodic features which are formed corresponding to the dot density of the thermal printhead. This results from the relatively easily deformable property of the layer and increases with the number of times of repeated heat application, thereby resulting in deterioration of the quality of images formed on the reversible thermosensitive recording medium.

In order to obviate the above-mentioned problem, an overcoat layer is proposed in JPA 62-55650 (1987), which is disposed on a recording layer to thereby reduce the coefficient of friction of the recording medium.

The above-mentioned overcoat layer, however, is found to have drawbacks such as an unsatisfactory adhesion to the underlying recording layer, resulting in peeling caused by repeated application of mechanical stress during the imaging processes, and in reduced quality of recorded images.

Further, to improve adhesion a layered structure for the recording medium is disclosed in JPA-1-133781 (1989), in which an intermediate layer composed primarily of resin is formed on a reversible thermosensitive recording layer, and an overcoat layer of heat-resistant resin is formed further thereon. By this expedient, the adhesion is found to be improved by the intermediate layer, and the deformation of the surface of the recording media is reduced by the overcoat layer.

In this case, however, there still remain disadvantages such as when scratches formed on the recording layer and portions of the overcoat layer are removed therefrom and then stuck to heating elements of a thermal printhead, by repeated application of mechanical stress during imaging processes. As these portions accumulate on the heating elements the heat conduction is hindered between the heating elements and the recording media, thereby resulting in difficulty in forming satisfactory images.

Still further, to obviate these disadvantages, a reversible thermosensitive recording medium is proposed in JPA-9-142037 (1997), in which an overcoat layer is provided on a recording layer for a reversible thermosensitive recording medium such that neither a peak temperature in the tan $\delta$ vs, temperature curve nor a characteristic temperature of dynamic relaxation related to the tan $\delta$ peak temperature is exhibited, wherein tan $\delta$ is defined by $G'/G''$, with dynamic modulus of elasticity represented by $G'$, and dynamic elastic loss represented by $G''$.

By the use of the thus prepared overcoat layer, the above-mentioned roughness on the recording layer, which has approximately periodic features corresponding to the dot density of the thermal printhead, can be prevented to some extent.

These recording materials are, however, found to have drawbacks such as the occurrence of cracks and sticking. The cracks are formed on the overcoat layer more often for recent imaging processes because of the ever increasing speed, in which an image forming/erasure apparatus such as, for example, a thermal printhead is used for heating under more severe conditions such as (1) a shorter heating period of the order of several milliseconds in order to achieve faster image processing, and/or (2) an increased printing pressure in order to achieve clearer printed images, whereby visibility of the formed images deteriorates due to the decreased transparency caused by these cracks. Furthermore, with an increasing the number of cracks, the surface property of the overcoat layer deteriorates, with portions of the overcoat layer being removed and then sticking onto a heating element of the thermal printhead. This also deteriorates image quality.

SUMMARY

It is therefore an object of the present invention to provide a novel reversible thermosensitive recording medium which overcomes the above-noted difficulties.

A further object of the present invention is to provide a reversible thermosensitive recording medium capable of satisfactorily carrying out the formation and erasure of images with a heating device such as, for example, a thermal printhead, by overcoming difficulties such as the occurrence of (1) cracks on the surface of an overcoat layer, aggravated especially by the application of heating pulses for shorter periods of time and/or at increased pressures during repeated processes of image formation and erasure with the thermal printhead, and (2) portions of the overcoat layer being removed therefrom and then sticking to heating elements of the thermal printhead, caused by repeated application of mechanical stress during imaging processes, whereby a sufficient visibility or clarity and excellent quality of recorded images may be achieved.

To achieve the foregoing and other objects, and to overcome the shortcomings discussed above, the invention in a first aspect provides a reversible thermosensitive recording medium comprising a supporting substrate, a reversible thermosensitive recording layer, and an overcoat layer, formed in the order recited, in which the recording layer changes transparency or color tone reversibly with temperature. The overcoat layer in the present invention is formed to have a temperature of at most 155° C. for a peak in a tan δ vs. temperature curve or a characteristic temperature of dynamic relaxation related to the tan δ peak temperature, wherein tan δ is defined by G'/G", with dynamic modulus of elasticity represented by G' and dynamic elastic loss represented by G". The tan δ peak temperature of the overcoat layer is preferably higher by at most 35° C. than a coloring temperature of the reversible thermosensitive recording layer. In addition, the overcoat layer has a temperature of at least 120° for a peak temperature of a tan δ vs. temperature curve or a characteristic temperature of dynamic relaxation related to the tan δ peak temperature.

According to another embodiment, a surface of the overcoat layer is preferably formed to have an arithmetic mean deviation of the surface profile (Ra) of at least 0.05 μm, a number of peaks (Pc) in each standard surface area of at least 3, and a coefficient of friction of at most 0.10.

According to still another embodiment, a matrix resin in the overcoat layer of the reversible thermosensitive recording medium comprises a thermosetting resin composition, an ultraviolet hardening resin composition or a electron beam hardening resin composition, and the matrix resin in the overcoat layer is formed by hardening the resin composition by either the application of heat, irradiation with ultraviolet radiation or by electron beam irradiation.

According to yet another embodiment, a matrix resin in the reversible thermosensitive recording layer of the reversible thermosensitive recording medium comprises a thermosetting resin composition, an ultraviolet hardening resin composition or a electron beam hardening resin composition, and the matrix resin in the recording layer is formed by hardening the resin composition by either the application of heat, irradiation with ultraviolet radiation or by electron beam irradiation.

According to another embodiment, a reversible thermosensitive recording medium further includes an information recording section. The information recording section comprises either a magnetic layer that is provided either at least in a portion between the supporting substrate and the thermosensitive recording layer, or at least in a portion on a side of the supporting substrate opposite the thermosensitive recording layer or a magnetic stripe provided at least on a portion of a displaying surface of the recording medium. Furthermore, the information recording section may include IC (integrated circuit) memories or optical memories which are provided at least in a portion of the reversible thermosensitive recording medium.

According to another embodiment, a reversible thermosensitive recording medium is provided with a color printed layer that is formed from a coloring agent and a resin binder and formed at least in a portion either above the overcoat layer or on a side of the supporting substrate opposite to the recording layer. The overcoat layer may include first and second compositional layers such that the second overcoat layer is provided on either the first overcoat layer overlying the recording layer or the color printed layer.

According to another embodiment, a method of forming and erasing an image on a reversible thermosensitive recording medium is provided, in which the reversible thermosensitive recording medium includes a supporting substrate, a thermosensitive layer provided on the supporting substrate, and an overcoat layer provided over the thermosensitive layer, wherein the thermosensitive layer changes transparency or color tone reversibly with temperature, and the overcoat layer has a temperature of at most 155° C. for the peak temperature of a tan δ vs. temperature curve. The formation and erasure of images is carried out by heating the reversible thermosensitive recording medium with a thermal printhead, a ceramic heater, a hot stamp, a heat roller, and/or a heat block, for example.

According to another embodiment, a method of forming and erasing an image on a reversible thermosensitive recording medium is provided, in which the reversible thermosensitive recording medium includes a supporting substrate, a thermosensitive layer provided on the supporting substrate, and an overcoat layer provided over the thermosensitive layer, wherein the thermosensitive layer changes transparency or color tone reversibly with temperature. The overcoat layer has a temperature not more than 35° C. higher than a coloring temperature of the reversible thermosensitive recording layer for a peak temperature of a tan δ vs. temperature curve. The formation and erasure of images is carried out by heating the reversible thermosensitive recording medium with a thermal printhead, a ceramic heater, a hot stamp, a heat roller, and/or a heat block, for example.

BRIEF DESCRIPTION OF THE DRAWINGS

Preferred embodiments of the invention are described hereinbelow with reference to the drawings wherein.

DESCRIPTION OF THE PREFERRED EMBODIMENTS

Figure 1:
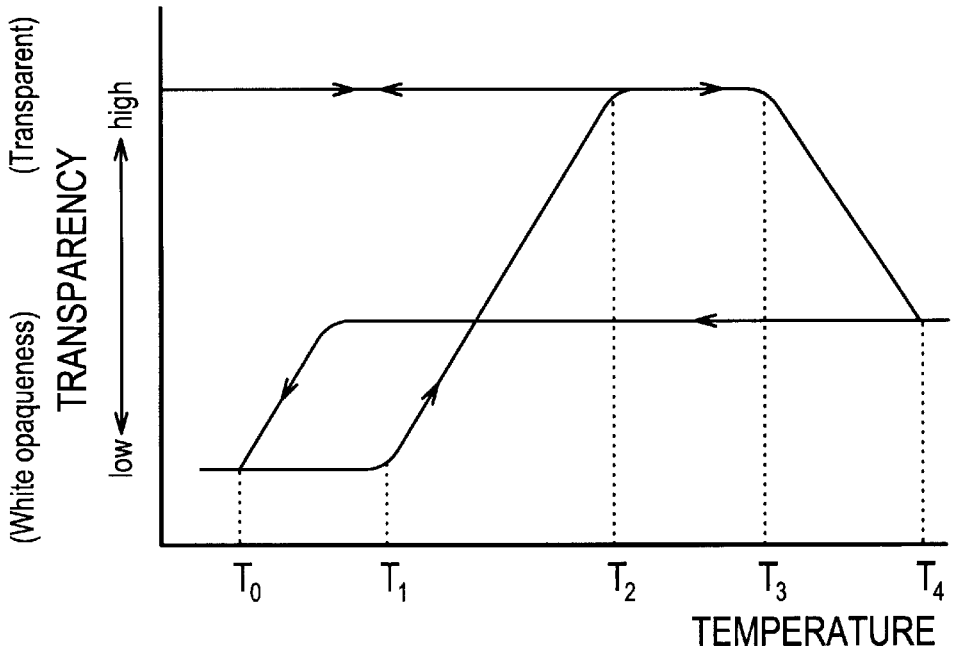
FIG. 1 is a diagram illustrating the dependence of transparency on the temperature of a reversible thermosensitive recording layer according to an embodiment of the present invention.

In the detailed description which follows, specific embodiments of the present invention useful in image recording applications are described. It is to be understood, however, that the present disclosure is not limited to these embodiments. For example, it will be appreciated that the recording media and image forming/erasure methods therefor disclosed herein are also adaptable to any form of reversible recording media. Other embodiments will be apparent to those skilled in the art upon reading the following description.

A reversible thermosensitive recording medium of the present invention comprises a layer of thermosensitive recording material capable of reversible exhibiting a change in transparency or in color tone, depending on the temperature.

Although this change may be broadly divided into changes in color and changes in shape, attention will be focused primarily on the former in the present invention. The change in color may include one in light transmittance, reflectivity, absorption wavelength, or scattering rate, and in combination thereof, so as to be utilized for displaying images.

More specifically, the recording layer of the present invention may be utilized so that the recording layer turns to a first colored state when heated to a first temperature higher than an ambient temperature, and then to a second colored state when heated to a second temperature higher than the first temperature and subsequently cooled.

Specific examples of the above-mentioned recording material preferably include ones which become (1) transparent at a first temperature and then white opaque at a second temperature (JPA 55-154198), (2) colored at a second temperature and colorless at a first temperature (JPA 4-224996, 4-247985, and 4-267190), (3) white opaque at a first temperature and transparent at a second temperature (JPA-3-169590), and (4) colored in, for example, black, red, or blue at a first temperature and colorless at a second temperature (JPA 2-188293 and 2-188294).

Of these materials, there are several recording materials preferably used, such as (1) those which change reversibly between a transparent and a white opaque state and (2) those which change by use of coloring dye or pigments.

The former material is typically exemplified by a thermosensitive layer in which a low molecular weight organic material, such as, for example, a higher alcohol or a higher fatty acid, is dispersed in a matrix resin such as polyester and other similar materials. The latter is typically exemplified by a leuco compound which is modified to have emphasized reversibility.

As described above, the former material which includes a low molecular weight organic material as a major ingredient, exhibits a reversible change between the transparent and white opaque states, and this change takes lace within a certain range of temperatures, which will be detailed hereinbelow.

A reversible thermosensitive recording material referably used in the present invention also exhibits the above-mentioned change in transparency between white opaqueness and transparency. The mechanism of this change is believed to be as follows.

Namely, the mechanism is based on the fact that (1) in the transparent state, particles of the low molecular weight organic material dispersed in the resin matrix are in close contact with a matrix resin without any space either between the particles or within the particle, so that light incident from one side can be transmitted to the other side without appreciable scattering, to thereby appear transparent, and (2) in the white opaque state, the particles of the low molecular weight organic material are composed of numerous minute crystals which form interstices at the interface between the minute crystals and the matrix resin, so that light incident from one side is reflected or scattered by the interfaces, to thereby look opaque white.

FIG. 1 is a diagram illustrating the temperature dependence of the transparency of a reversible thermosensitive recording layer disclosed herein.

Referring to FIG. 1, a thermosensitive layer comprising a matrix resin and a low molecular weight organic material dispersed in the matrix resin is at a white opaque state at an ambient temperature $T_0$ or below.

Upon heating to a temperature of $T_1$ and above, the thermosensitive layer gradually turns transparent and becomes completely transparent in a temperature range from $T_2$ to $T_3$. When this layer is cooled to an ambient temperature below $T_0$, the layer remains transparent.

The above phenomenon may be explained as follows. As the temperature is increased to $T_1$, softening of the resin sets in. As the softening proceeds, the resin fills the space between the resin and the particles of the organic material and between adjacent particles, so that the transparency increases. At a temperature ranging from $T_2$ to $T_3$, the low molecular weight organic material partly melts so that the remaining space is filled therewith, whereby the layer becomes transparent. When the layer is cooled, as mentioned above, the low molecular weight organic material crystallizes at a relatively high temperature because of the presence of seed crystals. In this case, since the resin still remains in a softened state, the resin can follow the volume change caused by the crystallization, so that no space is formed, i.e., the layer maintains to be transparent upon being cooled.

In contrast, when heated to a temperature $T_4$ or higher, the layer becomes translucent, which is a state between maximum transparency and opaqueness. When the temperature is subsequently lowered, the layer returns to the original white opaque state rather than to the transparent state.

This may be explained as follows. At a temperature of $T_4$ or higher, the low molecular weight material is completely melted. When the temperature is then lowered, the low molecular weight material becomes super-cooled and crystallizes at a temperature slightly higher than $T_0$. In this case, since the matrix resin has already started to solidify and is no longer at the softened state, the resin matrix cannot follow the volume change caused by the crystallization of the low molecular weight organic material. This results in the formation of space, whereby the opaque state is formed, as above-mentioned.

It may be noted that the transparency vs. temperature curve in FIG. 1 illustrates one of a number of typical examples, and the transparency characteristics may vary by changing the materials used.

The present invention will be described in detail hereinbelow, in which there has been found during rigorous investigation by the present inventors that, by properly controlling the dynamic relaxation property of an overcoat layer, the aforementioned difficulties such as the occurrence of cracks and sticking can be satisfactorily prevented.

Namely, a reversible thermosensitive recording medium of the present invention may be formed by providing an overcoat layer thereon with a tan δ peak temperature or related characteristic temperature of dynamic relaxation of at most 155° C. and which is higher by at most 35° C. than a coloring temperature of the recording medium in order to prevent the recording medium from developing cracks and sticking, which are caused by severe conditions such as shorter heating periods or higher printing pressures used during heating with a thermal printhead.

As described earlier, tan δ is defined by G'/G". The peak temperature of a tan δ vs. temperature curve is known to correspond to the temperature of α-dispersion (or primary dispersion) of the complex dynamic modulus of elasticity for a polymer material, in which no temperature related to either β- or γ-dispersion is included. Dynamic modulus of elasticity G' and dynamic elastic loss G" are generally obtained from dynamic heating measurements by applying various modes of vibrations to a test piece, and observing vibrations induced in the test piece with changing temperature in response to the applied vibrations.

Some of the modes of vibrations utilized in the measurements include unforced damping vibrations such as longitudinal (i.e., compression and tension), twisting, and bending vibrations; and forced vibrations under applied force such as compressive, tensile, twisting, or bending force.

The test piece is provided in a shape appropriate for the measurement being undertaken. Specific examples of shapes include a fiber, a film, bulk, and a composite of the testing material impregnated in a glass braid or coated on a metal spring.

For a composite with the glass braid, however, a measurement under unforced twisting damping vibrations, or a torsion braid analysis (TBA) method, in general, is not effective in providing absolute values, but does provide relative values of the dynamic modulus of elasticity G' and the dynamic elastic loss G". Accordingly, in the TBA method, changes in vibrational waveforms are observed to obtain relative rigidity Gγ and its logarithmic decay factor γ. In the measurement, the value γ is known to corresponds to tan δ, whereby the aforementioned characteristic temperature of dynamic relaxation can be obtained as a peak temperature of the γ values.

A reversible thermosensitive recording medium is in general subjected instantaneously to heating energy, shear, and platen pressure, during image forming and erasure processes. The heating energy, shear, and platen pressure are considered to induce deformations in the overcoat and/or recording layer. A tan δ peak temperature or related characteristic temperature of dynamic relaxation is therefore considered to be related to the above-mentioned heating energy, shear, and platen pressure during imaging processes.

A larger tan δ peak temperature or related characteristic temperature increases the surface hardness and heat resistance of the recording medium. However, this decreases the resistance against shear force or platen pressure and induces cracks on the surface of the overcoat layer, resulting in sticking which increases with increasing number of cracks.

In addition, the occurrence of cracks and sticking is considered to be enhanced with an increasing difference in the tan δ peak temperature or related characteristic temperature between the overcoat layer and the thermosensitive recording layer. The recording layer is in general deformed at relatively low temperatures while the overcoat layer does not deform up to high temperatures. Because of this difference in deformation characteristics at the interlayer portion between the overcoat layer and the thermosensitive recording layer, an interlayer distortion is formed to result in the occurrence of the cracks.

The present inventors investigated the occurrence closely in this context, and have found the occurrence can be prevented by providing an overcoat layer having a tan δ peak temperature or related characteristic temperature of dynamic relaxation of at most 155° C. and which is higher by at most 35° C. than a coloring temperature of the recording medium, as indicated earlier.

Furthermore, the tan δ peak temperature or related characteristic temperature of dynamic relaxation in the present invention preferably ranges from 120° C. to 155° C., more preferably ranges from 124° C. to 155° C., and most preferably ranges from 130° C. to 155° C.

As described earlier, the dynamic heating measurement method is broadly divided into two: one utilizes unforced damping vibrations and the other utilizes forced vibrations, each being applied to a test piece. The former method is carried out using a specified test piece with the following apparatus in air under applied vibrations ranging from 0.01 to 100 Hz at a temperature increasing at a rate of 35° C./min. These conditions are more preferably at a vibration frequency of 10 Hz and a rate of temperature increase of 3° C./min. If the measurement cannot be achieved with satisfactory sensitivity under the conditions undertaken, such as, for example, the above-mentioned 10 Hz vibration frequency and the 3° C./min increase rate, other feasible conditions may be selected, and the results are obtained by converting observed values according to Boltzmann's relation on superposition.

When the latter forced vibration method is used, measurements are carried out in air preferably at a temperature increasing at a rate of 35° C./min and more preferably in a range of from 2° to 3° C./min.

A plurality of test pieces used in these measurements are prepared in a similar manner, including the formation of the overcoat which is provided on the thermosensitive recording layer in the present invention, such as by using similar composition for the overcoat layer, by drying at a similar temperature for heating and aging periods, by being irradiated by ultraviolet light or by an electron beam, and by being formed into a shape appropriate for the measurements. Alternatively, pieces of the overcoat layer which are removed or peeled off from the recording layer may also be used for the measurements.

As aforementioned, an overcoat layer of the present invention is provided on the thermosensitive recording layer having a tan δ peak temperature or related characteristic temperature of dynamic relaxation, of at most 155° C. and which is higher by at most 35° C. than a coloring temperature of the recording medium. The composition for preparing this overcoat layer includes a thermosetting resin, an ultraviolet hardening resin, or an electron beam hardening resin, as a major ingredient. The resin composition may be used individually or in combination.

In addition, the resin composition may be selected from the group consisting of a polymer, a oligomer, a monomer, a cross-linking initiator, a cross-linking accelerator, an additive, and a plasticizer. In the present invention, the method using the thermosetting, ultraviolet hardening, or electron beam hardening resin composition is particularly effective for forming the overcoat layer with satisfactory adhesion to the thermosensitive recording layer.

When the thermosetting resin composition is used, the overcoat layer is formed first by coating and drying the above-mentioned thermosetting resin composition. Subsequently, the resulting coated layer is subjected to an aging process so as to obtain a tan δ peak temperature or related characteristic temperature of dynamic relaxation of at most 155° C. and which is higher by at most 35° C. than a coloring temperature of the recording medium.

The aging temperature preferably is at most the melting temperature of the low molecular weight organic material or the matrix resin, which is the major ingredient of the recording medium. An aging temperature higher than the above-mentioned temperature causes a decrease in recording sensitivity of the medium. A relatively lower aging temperature is therefore preferred with a longer aging period. Preferably, the aging temperature is from 30 to 60° C. with an aging period of from 1 to 14 days.

When the ultraviolet hardening resin composition is used, the overcoat layer is formed first by coating and drying the above-mentioned composition. Subsequently, the resulting coated layer is subjected to a hardening process with ultraviolet radiation so as to obtain a tan δ peak temperature or related characteristic temperature of dynamic relaxation of at most 155° C. and which is higher by at most 35° C. than a coloring temperature of the recording medium.

The energy of ultraviolet radiation used for the irradiation is preferably from 150 to 1500 mJ/cm$^2$. It is noted that in this case the aging process is not necessary, in contrast to the above-mentioned case in which the thermosetting resin composition is used. With the ultraviolet hardening resin composition, the overcoat layer can be formed with relative ease and at lower cost with the desired tan δ peak temperature or related characteristic temperature of dynamic relaxation property.

When the electron beam hardening resin composition is used, the overcoat layer is formed first by coating and drying the above-mentioned composition. Subsequently, the resulting coated layer is subjected to a hardening process with electron beam irradiation so as to obtain a tan δ peak temperature or related characteristic temperature of dynamic relaxation of at most 155° C. and which is higher by at most 35° C. than a coloring temperature of the recording medium.

The dosage of the electron beam used for the irradiation is preferably from 0.1 to 10 Mrad. An irradiation dosage of more than 10 Mrad causes decomposition of the hardened resin and/or matrix resin of the recording layer, resulting in unwanted coloring of these resin materials. It is noted that the aging process is not necessary, as is the case of the above-mentioned ultraviolet hardening resin composition. With this process, the overcoat layer can be formed with relative ease and at lower cost, which has a tan δ peak temperature or related characteristic temperature of dynamic relaxation of at most 155° C. and which is higher by at most 35° C. than a coloring temperature of the recording medium.

The overcoat layer of the present invention may also be formed by accumulating at least two kinds of compositional layers. With this construction, the effect is enhanced in obviating cracks and sticking.

In addition, the overcoat layer of the present invention may also be formed so that an arithmetic mean deviation of the surface profile (Ra) thereof is preferably at least 0.05 μm. With this construction, ink transfer capability can be improved.

This improvement is achieved for an Ra value of preferably from 0.05 to 0.8 μm, and more preferably from 0.05 to 0.5 μm. For an Ra value of less than 0.05 μm there is an increase in the contact area between the recording medium and a thermal printhead and a concomitant increase in frictional resistance, whereby sticking occurs more often.

For an Ra value of more than 0.8 μm, in contrast, there is an excessive decrease in the contact area between the recording medium and a thermal printhead, and a concomitant decrease in heat conduction from the printhead to the recording medium, whereby the thermal sensitivity of the reversible recording layer decreases.

Furthermore, the overcoat layer of the present invention may also be formed so that the number of the peaks (Pc) in each standard surface area is at least 3. It should be noted that (1) the above-mentioned standard surface area is 125 μm×125 μm, which corresponds to the area occupied by a single dot of a versatile thermal printhead with a dot density of 8 dots/mm, and (2) the number of the peaks (Pc) is obtained by counting the number of peaks having a height of at least 0.05 μm in the standard surface area.

With this construction, the aforementioned occurrence of portions of the overcoat layer being removed and then sticking onto a heating element can be obviated.

This improvement is achieved for a Pc value of preferably from 3 to 900, and more preferably from 3 to 500. A Pc value of at most 2 causes an increase in the contact area between the recording medium and a thermal printhead and a concomitant increase of frictional resistance, whereby sticking occurs more often. For a Pc value of at least 901, in contrast, there is a decrease in transparency and image contrast.

The number of the peaks (Pc) in each standard surface area is measured according to the method specified by Japanese Industrial Standard (JIS) B0601 with a contact or non-contact type of three-dimensional surface roughness tester (e.g., SE-30K from Kobayashi Laboratory KK, Japan).

Furthermore, the overcoat layer of the present invention may also be formed so as to have a coefficient of friction of at most 0.10, and the aforementioned occurrence of portions of the overcoat layer being removed therefrom and then sticking onto a heating element can be obviated with this construction. This improvement is achieved for a coefficient of friction of at most 0.10, and more preferably of at most 0.08. It should be noted that this coefficient is of kinetic friction of the overcoat layer.

The coefficient of friction is measured as follows. With a friction tester HEIDON-14S (from Shinto-Kagakusha KK., Japan), (1) an $Al_2O_3$ ball-shaped stylus of 5 mm in diameter is pressed with a force of 200 grams onto an overcoat layer provided on a reversible image recording layer, the layer being placed on a sample stage of the tester, (2) the sample stage is subsequently displaced horizontally at a speed of 150 mm/sec, (3) a force in the horizontal direction sensed by the stylus is measured, and (4) the coefficient of kinetic friction is thereby calculated from the force obtained as above after being divided by the weight.

The thermosetting resin composition suitable for the present invention includes a polymer and/or a polymeric compound which has at least one functional group capable of forming a covalent bond through the reaction with a cross-linking agent; a cross-linking agent; a cross-linking accelerator; a catalyst; a solvent; or other additives.

Specific examples of the above-mentioned polymer and/or polymeric compound, which have at least one functional group capable of forming a covalent bond, include polyvinyl alkylcarbamate, polyvinylbutyral, polyvinylacetal, polyvinylalcohol, ethyl cellulose, cellulose acetate, cellulose nitrate, polyurea, polyurethane, urethane prepolymer, carboxy denaturated polyurethane, amino denaturated polyurethane, polyurethane acrylate, polyester acrylate, epoxy acrylate, unsaturated polyester, polyether acrylate, N-methylol acrylamide, melamine, methylolmelamine, alkyd resin, phenol resin, silicone resin, furan resin, resocinol resin and epoxy resin.

The above-mentioned cross-linking accelerator or catalyst is suitably utilized with respect to the polymer and/or polymeric compound which has at least one functional group as mentioned above. Similarly, the above solvent is suitably utilized to resolve the polymer and/or polymeric compound selected.

Examples of suitable additives include either inorganic or organic particles which are composed of, for example, calcium carbonate, titanium oxide, zinc oxide, barium sulfide, aluminum silicate, magnesium hydroxide, magnesium carbonate, aluminum hydroxide, alumina, silica, urea-formalin resin, or styrene resin.

The amount of additive is preferably from 0 to 20% by weight, and more preferably from 0 to 10% by weight, per part by weight of the polymer and/or polymeric compound which has at least one functional group capable of forming a covalent bond through the reaction with the cross-linking agent. An amount of additive above 20% by weight causes a deterioration in image quality resulting from dirty heating elements of a thermal printhead.

The ultraviolet hardening resin composition suitable for the present invention includes a photo-polymerizable monomer (reacting diluent), photo-polymerizable oligomer, photo-polymerization initiator, solvent, and other additives.

Specific examples of the above-mentioned photo-polymerizable monomer include, but are not limited to, monofunctional monomers such as 2-hydroxyethyl acrylate, 2-hydroxypropyl acrylate, 2-ethylhexyl acrylate, and 2-hydroxyethyl acryloyl phosphate; bifunctional monomers such as 1,3-butanediol acrylate, 1,4-butanediol acrylate, 1,6-hexanediol diacrylate, diethylene glycol diacrylate, tripropylene glycol diacrylate, neopentyl glycol diacrylate, polyethylene glycol diacrylate, and hydroxypivalic ester neopentyl glycol diacrylate; polyfunctional monomers such as dipentaerythritol triacrylate, pentaerythritol triacrylate, and trimethylolpropane triacrylate.

Specific examples of ultraviolet hardening oligomers include polyester acrylate, epoxy acrylate, polyurethane acrylate, polyether acrylate, silicone acrylate, alkyd acrylate, and melamine acrylate.

The following monomers (reacting diluents) and oligomers are suitably used in the present invention. These compounds are used at least individually or in combination, and include (i) epoxy acrylate with the skeltal structure of bis-phenol A, or acrylate of bisphenol A diglycidylether polymer, which is commercially available (from Showa Polymer KK) as Ripoxy SP-1507, SP-1509, SP-1519, SP-1563, VR-60, VR-77, or VR-90; Biscoat 540 (from Osaka Yuki KK), or epoxy-ester 3000A (from Kyoei-sha Kagaku KK) and (ii) dipentaerythritol monohydroxy pentaacrylate which is commercially available as SP399, SP399E, or SP9041 (from Thertomer KK).

Specific examples of the above-mentioned photo-polymerization initiator include, but are not limited to, benzophenone, benzoyl methylbenzoate, diethoxy acetophenone, 2-hydroxy-2-methyl-1-phenylpropane-1-on, 1-hydroxy cyclohexyl phenylketone, 2-methyl-1-(4-methylthio)phenyl-2-) morpholino-propane-1, benzoin isobutyl ether, benzoin ethyl ether, benzyl dimethylketal, 2-chlorothioxanthone, and 2,4-diethylthioxanthone.

Specific examples of the above-mentioned additive in the ultraviolet hardening resin composition include, but are not limited to, either inorganic or organic particles which are appropriately used for forming a rough surface on the overcoat layer of the recording medium, a surfactant which is used for reducing the coefficient of friction of the overcoat layer, a sensitizer, an antioxidant, a photo-stabilizer, an aging inhibitor, a thermal reaction inhibitor, a leveling agent, a surfactant, and an antistatic agent.

Examples of the inorganic or organic particles suitable for the present invention include, for example, calcium carbonate, silica, talc, titanium oxide, zinc oxide, barium sulfide, aluminum silicate, magnesium hydroxide, magnesium carbonate, aluminum hydroxide, alumina, urea-formalin resin, or styrene resin. The average diameter of the particles preferably ranges from 0.1 to $\mu$m, and more preferably from 0.2 to 5 $\mu$m.

The amount of additive to be added to the ultraviolet hardening resin composition is preferably from 0 to 20% by weight, and more preferably from 0 to 10% by weight, per part by weight of the photo-polymerizable monomer (reacting diluent) and oligomer. An amount of additive above 20% by weight causes a deterioration in image quality resulting from dirty heating elements of the thermal printhead. In addition, the solvent which is used for diluting and coating the ultraviolet hardening resin composition is suitably selected so as to appropriately resolve the above-mentioned photo-polymerizable monomer and oligomer.

The electron beam hardening resin composition suitable for the present invention includes an unsaturated prepolymer, oligomer, reacting diluent (monomer), solvent and other additive.

Examples of the unsaturated prepolymer and oligomer include unsaturated polyester, polyester acrylate, epoxy acrylate, polyurethane acrylate, polyether acrylate, unsaturated acrylic resin, unsaturated silicone, and unsaturated fluorinated resin.

Specific examples of the reacting monomer include n-butyl acrylate, 2-ethylhexyl acrylate, 2-hydroxypropyl acrylate, trimethylol acrylate, and pentaerythrithol acrylate.

Examples of the additive in the electron beam hardening resin composition include, but are not limited to, either inorganic or organic particles which are appropriately used for forming a rough surface on the overcoat layer of the recording medium, a surfactant which is used for reducing the coefficient of friction of the overcoat layer, a sensitizer, a antioxidant, a photo-stabilizer, an aging inhibitor, a thermal reaction inhibitor, a leveling agent, a surfactant, and an antistatic agent.

Examples of the inorganic or organic particles suitable for the present invention include, for example, calcium carbonate, silica, talc, titanium oxide, zinc oxide, barium sulfide, aluminum silicate, magnesium hydroxide, magnesium carbonate, aluminum hydroxide, alumina, urea-formalin resin, or styrene resin. The average diameter of the particles preferably ranges from 0.1 to 10 $\mu$m, and more preferably from 0.2 to 5 $\mu$m.

The amount of additive to be added to the electron beam hardening resin composition is preferably from 0 to 20% by weight, and more preferably from 0 to 10% by weight, per part by weight of the unsaturated prepolymer, oligomer, and reacting diluent (monomer). An amount of additive above 20% by weight causes a deterioration in image quality resulting from dirty heating elements of the thermal printhead. In addition, the solvent for diluting and coating the electron beam hardening resin composition is suitably selected so as to appropriately resolve the unsaturated prepolymer, oligomer, and reacting diluent.

The thickness of the overcoat layer suitable for the recording medium of the present invention preferably ranges from 0.5 to 15.0 μm, and more preferably from 1.0 to 10.0 μm. A thickness of at most 0.4 μm is insufficient to achieve an appropriate hardness of the layer, whereas a thickness of at least 16 μm causes an decrease in thermal sensitivity.

The overcoat layer of the present invention may be formed on the thermosensitive recording layer by several methods commonly used in the field.

Illustrative examples of the methods of forming the overcoat layer include coating methods such as dip coating, spray coating, flow coating, roll coating, wire bar coating, die coating, and gravure coating. Printing methods including offset, gravure, and screen printing. When the above coating methods are used, a coating composition is applied after appropriately diluting with the aforementioned solvent, since a coating composition with a relatively low viscosity is suitable for these coating methods. In contrast, when the printing methods are used, a coating composition is applied after appropriately diluting with the aforementioned reacting diluent (monomer) to obtain another viscosity, since a coating composition with a relatively high viscosity is suitable for the printing methods.

In addition, since the coating method is similar to the method of forming the thermosensitive recording layer, the coating method is used preferably to form a first overcoat layer overlying the recording layer. In contrast, since the printing method is similar to that of forming the color printed layer, this method is used preferably to form a second overcoat layer overlying the first overcoat layer or the color printed layer. Further, since no other color printed layer is necessary on the second overcoat layer, a layer composed of silicone or fluorine resin may additionally be provided instead to smoothen the surface of the recording medium.

As described earlier, the thermosensitive recording layer is formed by coating and then drying a coating composition. This coating composition is prepared in general by resolving or by dispersing into a solvent at least one kind of low molecular weight organic material and a matrix resin.

The solvent used for forming the recording layer may be selected in various ways according to the kinds of matrix resin and low molecular weight organic material used and may be selected from, for example, ethanol, toluene, benzene, chloroform, carbon tetrachloride, ethyl acetate, methyl ethyl ketone, methyl isobutyl ketone, tetrahydrofuran, and combinations thereof. In a thermosensitive layer obtained from dispersion or from solution, the low molecular weight organic material exists in the form of fine particles dispersed therein.

In the reversible thermosensitive recording medium, it is preferable to employ a matrix resin that can form a thermosensitive recording layer in the form of a film, and which can impart high transparency and mechanical stability to the recording layer.

Illustrative examples of the resin useful for the matrix of the present invention include, but are not limited to, polyvinyl chloride; vinyl chloride copolymers such as vinyl chloride-vinyl acetate copolymer, vinyl chloride-vinyl acetate-vinyl alcohol copolymer, vinyl chloride-vinyl acetate-maleic acid copolymer, and vinyl chloride-acrylate copolymer; vinylidene chloride copolymers such as polyvinylidene chloride, vinylidene chloride-vinyl chloride copolymer and vinylidene chloride-acrylonitrile copolymer; polyester; polyamide; polyacrylate; polyacrylate-polymethylacrylate copolymer; and silicone resin. These resins are used individually or in combination.

The low molecular weight organic material should be in the form of particles in the recording layer. Generally used is a material having a melting point ranging from 35° to 200° C., and preferably from 50° to 150° C. Examples of the low molecular weight organic materials include, but are not limited to, alkanols, alkane dioles, halogenated alkanols, halogenated alkane diols, alkylamines, alkanes, alkenes, alkynes, halogenated alkanes, halogenated alkenes, halogenated alkynes, cycloalkanes, cycloalkenes, cycloalkynes, saturated or unsaturated mono or dicarboxylic acids or esters, amides or ammonium salts thereof; saturated or unsaturated halogenated fatty acids or esters, amides or salts thereof; allylcarboxylic acids or esters, amides or salts thereof; halogenated arylcarboxylic acids or esters, amides or salts thereof; thioalcohols; thiocarboxylic acids or esters, amines or ammonium salts thereof; and carboxylic acid esters of thioalcohol. These low molecular weight organic materials are used individually or in combination. These compounds have from 10 to 60 carbon atoms, preferably from 10 to 38, and more preferably from 10 to 30. The alcohol group of the ester may be saturated or unsaturated, or may be substituted with a halogen. It is preferred that the low molecular weight organic material has a group including at least one of oxygen, nitrogen, sulfur and a halogen in its molecule, such as —OH, —COOH, —$CONH_2$, —COOR, —NH, —$NH_2$, —S—, —S—S—, —O—, or a halogen.

In the present invention, it is preferred that low melting point and high melting point low molecular weight organic compounds are used in combination as the low molecular weight material to further increase the temperature range in which the recording material is in the transparent state. The difference in melting point between the low and high melting point compounds is preferably at least 20° C., more preferably at least 30° C., and most preferably at least 40° C.

The low melting point low molecular weight organic compound preferably has a melting point of between 40° and 100° C., and more preferably between 50° C. and 80° C., whereas the high melting point low molecular weight organic compound preferably has a melting point of between 100° C. and 200° C., and more preferably between 110° C. and 180° C.

The low melting point low molecular weight organic material is preferably a fatty acid ester, an ester of dibasic acid, or a dibasic carboxylic acid ester of polyhydric alcohol, as described hereinafter. These esters may be used individually or in combination.

The fatty acid ester used in the present invention is characterized in that the melting point thereof is lower than the fatty acid (two molecules being in the associated state) having the same carbon number, and in that the carbon number thereof is greater than the fatty acids having the same melting point.

Deterioration of images during repeated recording-erasure with a thermal printhead is considered to be caused by a change in the dispersed state of particles of the low molecular weight organic material due to the dissolution of the low molecular weight organic material in the matrix resin during a heating stage. It is believed that the compatibility of the matrix resin with the low molecular weight organic material is lowered with an increase in the carbon number of the low molecular weight material, so that the deterioration of images by recording-erasure operations is decreased. Furthermore, the white opaqueness tends to increase in proportion with an increase in the carbon number.

Therefore, in a reversible thermosensitive recording material having the same transparentizing temperature, the use of a fatty acid ester as the low molecular weight organic material to be dispersed in the matrix resin provides an improvement in white opaqueness (i.e., contrast) and durability in repeated use as compared with the case in which a fatty acid is used.

By using such a fatty acid ester in conjunction with a high melting point low molecular weight material, the transparentizing temperature range can be broadened and the erasure characteristics by a thermal printhead can be improved. As a consequence, even when the erasure characteristics change during storage, the recording material still permits erasure. In addition, because of the characteristics of the recording material itself, which has no carboxy group in its structure, the durability with repeated use can be improved.

The fatty acid ester suitably used in the present invention may be represented, for example, by the following general formula (I):

$$R_1—COO—R_2 \quad (I),$$

wherein $R_1$ and $R_2$ each represent an alkyl group having at least 10 carbon atoms.

The fatty acid ester preferably has at least 20 carbon atoms, more preferably at least 25 carbon atoms, and most preferably at least 30 carbon atoms. As the number of carbon atoms increases, the durability with repeated use is improved. The fatty acid ester preferably has a melting point of at least 40° C., and is used individually or in combination of two or more.

Specific examples of fatty acid esters for use in the present invention include octadecyl palmitate, dococyl palmitate, heptyl stearate, octyl stearate, octadecyl stearate, dococyl stearate, octadecyl behenate, and dococyl behenate.

Dibasic acid esters may be either monoester or diester and may be represented by the following general formula (II), $$ROOC—(CH_2)_n—COOR' \quad (II),$$

wherein R and R' represent, independently from each other, a hydrogen atom or an alkyl group having from 1 to 30 carbon atoms, and n is an integer of from 0 to 40.

In the ester of the dibasic acid represented by the formula (II), the alkyl groups R and R' preferably have from 1 to 22 carbon atoms, while n is preferably from 1 to 30, and more preferably from 2 to 20. The ester preferably has a melting point of at least 40° C.

Illustrative examples of the ester of the dibasic acid include esters of succinic acid diesters, adipic acid diesters, sebatic acid diesters, and 1,18-octadecamethylene dicarboxylic acid diesters.

The difatty acid ester of the polyhydric alcohol used as the low molecular weight organic material may be a compound represented by the following general formula (III)

$$CH_3(CH_2)_{m-2}COO(CH_2)_nOOC(CH_2)_{m-2}CH_3 \quad (III),$$

wherein n is an integer of from 2 to 40, preferably from 3 to 30, and more preferably from 4 to 22, and m is an integer of from 2 to 40, preferably from 3 to 30, and more preferably from 4 to 22.

Specific examples of the ester include 1,3-propanediole dialkanoic acid esters, 1,6-hexanediole dialkanoic acid esters, 1,10-decanediole dialkanoic acid esters, and 1,18-octadecanediole dialkanoic acid esters.

Examples of the high melting point low molecular weight organic compound used in the present invention includes, but are not limited to, aliphatic saturated dicarboxylic acid, ketones having a higher alkyl group, semicarbazones derived therefrom, and α-sulpho fatty acid, and is used individually or in combination.

Specific examples of the low molecular weight organic material with a melting temperature of 100° C. or more include aliphatic dicarboxylic acids with a melting temperature of from 100° C. to 135° C., such as succinic acid, glutaric acid, adipic acid, pimeric acid, suberic acid, azelaic acid, sebasic acid, undecanedionic acid, dodecanedionic acid, tetradecanedionic acid, pentadecanedionic acid, hexadecanedionic acid, heptadecanedionic acid, octadecanedionic acid, nonadecanedionic acid, eicosanedionic acid, heneicosanedionic acid, and docosanedionic acid.

The ketone used in the present invention contains a ketone group and a higher alkyl group as essential constituents and may additionally contain a substituted or non-substituted aromatic or heterocyclic group. The total number of carbon atoms of the ketone is preferably at least 16, and more preferably at least 21. The carbazones used in the present invention are derived from the above ketone.

Examples of the ketone include 3-octadecanone, 7-icosanone, 14-heptacosanone, 18-pentatriacontanone, tetradecanophenone, docosanophenone, docosanonapththophenone, and 2-heneicosanonesemicarbazone.

The α-phosphonofatty acids used in the present invention may be obtained by, for example, the method described by E. V. Kaurer et al. in J. Am. Oil Chemist's Soc. 41, 205 (1964). In this method, a fatty acid is first brominated by the Hell-Volhard-Zelinskin reaction to an α-brominated product which in turn is esterized with ethanol to obtain an α-bromofatty acid ester. This is reacted with triethyl phosfite by heating to obtain an α-sulphonofatty acid ester. The ester is hydrolized with concentrated chloric acid and the product is recrystallized from toluene.

Illustrative examples of the phosphono acid for use in the present invention are an α-phosphonomyristic acid, an α-phosphonopalmitic acid, and an α-phosphonostearic acid. These compounds other than the α-phosphonopelgoic acid have two melting points.

The weight ratio of the low melting point low molecular weight organic material to the high melting point low molecular weight organic material is preferably from 95:5 to 5:95, more preferably from 90:10 to 10:90, and most preferably from 80:20 to 20:80. Into the mixture of the above low meting point and high meting point materials may be incorporated other low molecular weight organic materials.

Illustrative examples of these materials include higher aliphatic acids such as lauric acid, dodecanic acid, myristic acid, pentadecanic acid, palmitic acid, stearic acid, behenic acid, arachidic acid, and oleic acid.

Examples of low molecular weight organic compounds also include ether or thioether, such as $C_{16}H_{33}—O—C_{16}H_{33}$, $C_{16}H_{33}—S—C_{16}H_{33}$, $C_{18}H_{37}—S—C_{18}H_{37}$, $C_{12}H_{25}—S—C_{12}H_{25}$, $C_{19}H_{39}—S—C_{19}H_{39}$, $C_{12}H_{25}—S—S—C_{12}H_{25}$,

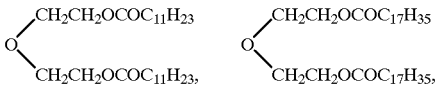

-continued

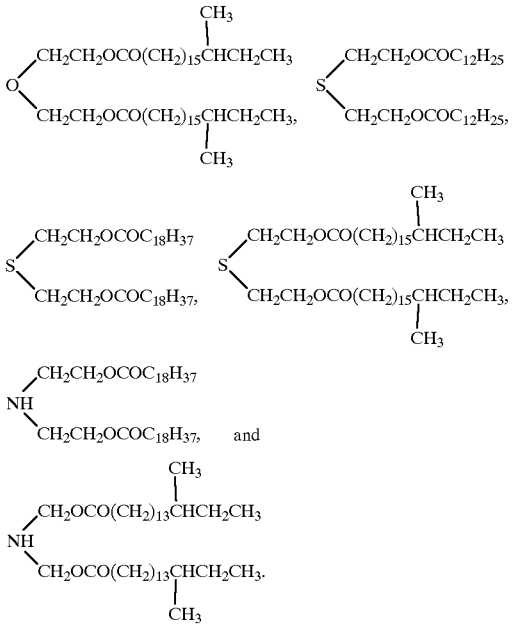

Of the above-mentioned compounds, it is preferable to use a higher fatty acid, especially a higher fatty acid having at least 16 carbon atoms such as palmitic acid, pentadecanic acid, nonadecanic acid, arachidic acid, stearic acid, behenic acid, or glyceric acid, and more preferably a higher fatty acid having from 16 to 24 carbon atoms.

As described previously, in the present invention, the widening of the transparentizing temperature range may be achieved by suitably combining the aforementioned low molecular weight organic materials or by using the low molecular weight organic materials with other materials having a different melting point. These are disclosed, for example, in JPA 63-39378 (1988), 63-130380 (1988), 63-14754 (1988) and 3-2089 (1991), but are not limited only thereto.

The weight ratio of the low molecular weight organic material to the resin (the resin having a cross-linked structure) in the recording layer is preferably from 2:1 to 1:16, and more preferably from 1:2 to 1:8. A proportion of the resin below the above range causes a difficulty in forming a film in which the low molecular weight organic material is retained in the resin. An amount above the above range also causes a difficulty in achieving a proper white opaqueness because the amount of the low molecular weight organic material is small.

It is preferred that the recording layer have a thickness of from 1 to 30 microns, more preferably from 2 to 20 microns. Too large a thickness of the recording layer causes difficulty in uniformly transparentizing the recording layer, because a temperature variation occurs in the layer. On the other hand, too small a thickness of the recording layer causes a reduction in the white opaqueness and the contrast.

The recording layer may contain, in addition to the above constituent materials, additives such as a plasticizer and a surfactant to facilitate the formation of transparent images, which will be described hereinbelow.

Plasticizers useful for the present invention are esters of phosphoric acid, fatty acid, phthalic acid, or dibasic acid; glycols; polyester plasticizers; and epoxy plasticizers.

Specific examples of the plasticizers in the present invention include tributyl phosphate,
tri-2-ethylhexyl phosphate,
triphenyl phosphate,
tricresyl phosphate,
butyl oleate,
dimethyl phthalate,
diethyl phthalate,
dibutyl phthalate,
dihepthyl phthalate,
di-n-octyl phthalate,
di-2-ethyhexyl phthalate,
diisononyl phthalate,
dioctyldecyl phthalate,
diisodecyl phthalate,
butylbenzyl phthalate,
dibutyl adipate,
di-n-hexyl adipate,
di-2-ethylhexyl adipate,
di-2-ethylhexyl azelate,
dibutyl sebacate,
di-2-ethylhexyl sebacate,
diethylene glycol dibenzoate,
triethylene glycol di-2-ethylbutylate,
methyl acetylricinoleate,
butyl acetylricinoleate,
butylphtalyl butyl glicolate, and
tributyl acetylcitrate.

Specific examples of the surfactant and other additives include higher fatty acid esters of a polyhydric alcohol,
higher alkyl ethers of a polyhydric alcohol,
a higher alcohol,
a higher alkyl phenol,
a higher fatty acid higher alkyl amine,
a higher fatty acid amide,
a fat or lower olefin oxide adducts of polypropylene glycol,
acetylene glycol,
Na, Ca, Ba or Mg salts of higher alkyl benzenesulfonic acid,
Na, Ca, Ba or Mg salts of an aromatic carboxylic acid, a fatty acid sulfonic acid, aromatic sulfonic acid, sulfuric acid monoester or a mono or diester of phosphoric acid,
low degree sulfonated oil,
poly(long chain alkyl acrylate),
acrylic oligomers,
poly(long chain alkyl methacrylate),
copolymers of long chain alkyl methacrylate with an amine-containing monomer,
styrene-maleic anhydride copolymers, and
olefin-maleic anhydride copolymers.

A plurality of methods of cross-linking a resin composition will be described for forming the matrix resin contained in the reversible thermosensitive recording layer, including a thermosetting resin composition, a ultraviolet hardening resin composition, and an electron beam hardening resin composition.

When a coating composition including a thermosetting resin composition for forming the reversible thermosensitive recording layer is used, the recording layer is formed first by coating, drying, and then aging the coating composition.

The temperature for the aging process is preferably below the melting point of either a low molecular weight material or matrix resin in use as major ingredients of the recording layer. The aging temperature is preferably at most a melting point of either the low molecular weight organic material or the matrix resin as the major ingredient of the recording medium. An aging temperature higher than the above temperature causes a decrease in recording sensitivity of the medium because of an adverse change in the dispersion of the low molecular weight material in the matrix resin. A relatively lower aging temperature is therefore preferred with a longer aging period. A specific example of the aging temperature is preferably from 30 to 60° C. with an aging period of from 1 to 14 days.

When a coating composition for forming the recording layer includes an ultraviolet hardening resin composition is used, the recording layer is formed of the coating composition by coating, drying, and then hardening through ultraviolet irradiation. The energy of ultraviolet radiation used for the hardening is preferably from 150 to 1500 mJ/cm$^2$. It is noted that the aging process is not necessary in contrast to the above-mentioned case using the thermosetting resin composition. With the ultraviolet hardening resin composition, the overcoat layer can be formed with relative ease and at lower cost.

When a coating composition for forming the recording layer is used includes an electron beam hardening resin composition, the recording layer is formed of the coating composition by coating, drying, and then hardening through electron beam irradiation. The dosage used for the irradiation is preferably from 0.1 to 10 Mrad. An irradiation dosage of more than 10 Mrad causes decomposition of the hardening resin and/or the matrix resin of the recording layer, resulting in undesired coloring of these resin materials. It is noted that the aging process is not necessary, as is the case of the above-mentioned ultraviolet hardening resin composition. With this process, the overcoat layer can be formed with relative ease and at lower cost.

The thermosetting resin composition suitable for forming the thermosensitive recording layer in the present invention includes polymers and/or polymeric compounds which have at least one functional group capable of forming a covalent bond through reaction with a cross-linking agent; a cross-linking agent; a solvent; a cross-linking accelerator; and a catalyst. These polymers and/or polymeric compounds, cross-linking agents, solvents, cross-linking accelerators, and catalysts may suitably be selected from those previously described for forming the recording layer and overcoat layer.

The ultraviolet hardening resin composition suitable for forming the recording layer includes a photo-polymerizable monomer (reacting diluent), a photo-polymerizable oligomer, a photo-polymerization initiator, and a solvent. The photo-polymerizable monomer (reacting diluent), photo-polymerizable oligomer, photo-polymerization initiator, and solvent may suitably be selected from those previously described for forming the recording layer and overcoat layer.

The electron beam hardening resin composition suitable for forming the recording layer includes an unsaturated prepolymer, an oligomer, a reacting diluent (monomer), and a solvent. The unsaturated prepolymer, oligomer, reacting diluent, and solvent may suitably be selected from those previously described for forming the recording layer and overcoat layer.

In the present invention, a thermosensitive recording material which gives rise to color formation is also utilized in the recording layer. This color formation is caused by a reaction of a coloring agent, such as an electron-donating coloring compound, with a color developer, such as an electron-accepting compound.

When a composition as above, which consists of the electron-donating coloring compound and the electron-accepting compound, is heated to a temperature high enough to be melted, a colored amorphous compound is formed. When the colored amorphous compound is heated to a temperature lower than its melting point, the compound becomes colorless upon crystallization. It is the above-mentioned coloring/erasing property of this coloring compound that is utilized in the present invention for reversible thermosensitive recording.

A colored state of the amorphous colored compound results instantaneously upon melting and is stable at ambient temperatures. In addition, a colorless state, which is instantaneously formed by heating the colored amorphous compound to a temperature below its melting point, is also stable at ambient temperatures.

Figure 2:
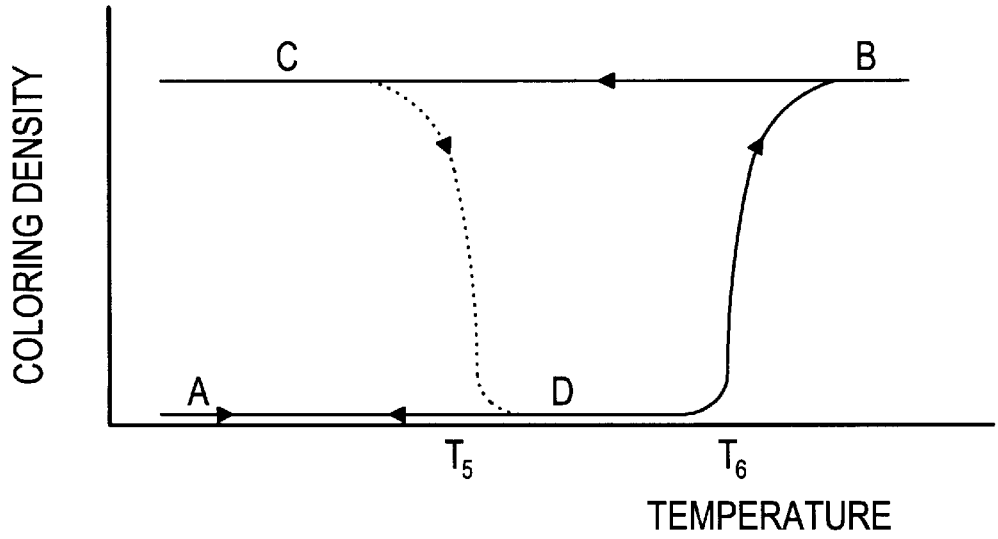
FIG. 2 is a diagram illustrating the dependence of color tone on the temperature of a reversible thermosensitive recording layer according to an embodiment of the present invention.

FIG. 2 illustrates the dependence of color tone or density on the temperature of a reversible thermosensitive recording layer. Referring to FIG. 2, an image forming process is shown by a solid curve. The character A in FIG. 2 denotes an optical density of the recording material in which images are completely erased. When a recording material is heated to a temperature above $T_6$, the material becomes colored (optical density B) and remains colored (C) when cooled to a temperature below $T_5$. The material is erased (D) when subsequently heated to a temperature between $T_5$ and $T_6$.

The recording material with this composition is in a colorless state (a first color state) or the state (A) at a temperature below $T_5$. When the recording material is heated to a temperature above $T_6$ with a thermal printhead, for example, the recording material becomes colored (B), resulting in the formation of an image. The formed color image of the recording material remains at the colored state C (a second colored state), when the recording material is cooled to a temperature below $T_5$, as shown by a solid curve ABC in FIG. 2, thereby retaining memory characteristics.

When the recording material having the formed images is heated to a temperature between $T_5$ and $T_6$, which is lower than the coloring temperature, the recording material becomes colorless (D) and the image is erased. If the colorless recording material is cooled to a temperature below $T_5$, the colorless state is maintained and becomes state (A), as the change CDA shown in FIG. 2. This image forming and erasing operation can be repeated reversibly.

In addition, by carrying out the erasing process after heating the recording layer above $T_6$, the particles of the coloring agent and color developer returns to the original state, thereby facilitating regeneration of the colored state.

This thermosensitive material includes a coloring agent and a color developer as main ingredients, and may further include a binder resin. A colored state is formed by melting by heat the electron-donating coloring compound and the electron-accepting compound. The colored state is erased by heating to a temperature lower than the coloring temperature, whereby the alteration of the colored and erased states can be retained at room temperature.

As described earlier, this state alteration is considered to be due to a mechanism in which the colored state is formed by the formation of a colored amorphous compound when the electron-donating coloring compound and the electron-accepting compound are heated to a temperature high enough to be melted, and the colored amorphous compound turns colorless upon crystallization when heated to a temperature lower than the coloring temperature.

It is noted that this alteration is achieved for the original states of the electron-donating coloring compound and the electron-accepting compound which are recovered by heating the recording layer to a temperature higher than $T_6$, thereby facilitating regeneration of the colored state.

A conventional reversible thermosensitive recording material includes a composition of a coloring agent such as a leuco compound having a lacton ring, and a color developer such as a phenolic compound. When this composition melts by heating, the leuco compound becomes colored due to opening of the lacton ring, thereby forming a color image. The colored image is thus due to an amorphous substance in which the leuco compound and the phenolic compound are mutually dissolved. The amorphous substance is stable even at room temperature and does not become colorless when heated again. The reason for this change is considered to be as follows. In this composition, the phenol compounds are neither separated from the leuco group nor produce the ring opening in the lacton group, thereby resulting in no colorless state.

In the present invention, in contrast, the composition of the coloring agent and the color developer form a colored amorphous substance, and the composition becomes colorless when heated again to a temperature below the coloring temperature. In addition, since the color developer crystallizes and is separated from the coloring agent due to weakening of the bond between the coloring agent and the coloring developer, the electron donation and acceptance between the coloring agent and the color developer do not occur and the composition therefore becomes colorless.

The coloring agent and the color developer for use in the recording material of the present invention include known electron-donating agent and known electron-accepting color developer. However, these materials should be combined so that a colored amorphous substance is formed when heated, and the color developer crystallizes when the colored amorphous substance is heated again to a temperature below the coloring temperature. This combination may suitably be used as a constituent of the coloring material in the present invention.

The above-mentioned characteristics of these materials are ascertained with relative ease by a thermal analysis. In the thermal analysis, melting of these materials is found to be endothermic and crystallization of the color developer is found to be exothermic. This type of reversible thermosensitive recording material (reversible thermosensitive coloring material) may include auxiliary agents such as a binder resin, where relevant. Even when a binder resin is included in the recording layer, the reversible coloring/erasing operation has been found to be maintained. Examples of the binder resin include the aforementioned resins used in the reversible thermosensitive recording material.

Since the color erasing is caused by crystallization followed by separation of the color developer from the coloring agent, an appropriate selection of the color developer is important to achieve excellent erasing characteristics. Specific examples of color developers include, but are not limited to, those disclosed in JPA 4-224996, 4-247985 and 4-267190.

When the reversible thermosensitive recording medium is used in a reflection mode for displaying images, it is preferred that a light reflecting layer be provided behind the recording layer. The reflecting layer can increase the contrast even when the thickness of the recording layer is relatively small. Specifically, the light reflecting layer may be formed by disposing aluminum, nickel, or tin, for example, on the supporting substrate, as disclosed in JPA 64-14079 (1989).

The aforementioned color printed layer is provided with coloring agents dispersed in a binder. Examples of color agents suitably used in the invention include a dye or pigment, which is included in a color ink used in well-known full color printing. The composition for preparing the binder includes those of a thermosetting resin, an ultraviolet hardening resin, or an electron beam hardening resin as a major ingredient. The thickness of the color printed layer may preferably be adjusted so as to achieve an appropriate printed color density.

When the ultraviolet hardening resin is used, the binder in the invention is formed by hardening a resin composition including the aforementioned cross linking agents, photopolymerization initiators, and photopolymelization accelerators, which are used for hardening the matrix resin in the thermosensitive recording layer.

In addition, an intermediate layer may be interposed between the protective layer and the recording layer to protect the recording layer from solvent or a monomer component in a liquid used for forming the protective layer, as disclosed in JPA 1-133781 (1989).

As the material for the intermediate layer, the following thermosetting resins and thermoplastic resins may be used in addition to the aforementioned resin materials for forming the recording layer. Examples of the suitable materials include polyethylene, polypropylene, polystyrene, polyvinyl alcohol, polyvinyl butyral, polyurethane, saturated polyester, unsaturated polyester, epoxy resin, phenolic resin, polycarbonate, and polyamide. The thickness of the intermediate layer is preferably from 0.1 to 2 $\mu$m.

As to the layer construction of the reversible thermosensitive recording material of the present invention, there may be used a construction in which, as disclosed in Japanese Laid-Open Utility Model Application No. 2-3876 (1989), a thermosensitive recording layer and a magnetic recording layer containing a magnetic material, as a main ingredient, are provided on a supporting substrate such that at least the portion immediately below the thermosensitive recording layer or the portion of the supporting substrate corresponding to the thermosensitive recording layer is colored.

Alternatively, as disclosed in JPA 3-130188 (1991), there may be used a construction in which a supporting substrate is overlaid with a magnetic recording layer, a light reflecting layer and a thermosensitive layer, in this order. In this case, the magnetic recording layer may be provided either on the backside of the supporting substrate or between the supporting substrate and thermosensitive layer. Other layer constructions may be used, if desired.

A colored layer may be further provided between the supporting substrate and the recording layer to improve visibility. The color layer may be formed by applying and drying a solution or a dispersion containing, as main ingredients, a coloring agent and a resin binder, or by applying a color sheet.

Any color agent may be used so long as the color agent permits the recognition of change between transparency and white opaqueness of the overlying recording layer as a reflected image. A dye or pigment of red, yellow, blue, deep blue, violet, black, brown, gray, orange, or green may be used. Binder resins useful in the color layer may be a thermoplastic, thermosetting, or UV-curable resin.

An air layer of an air-containing non-adhesion portion may be interposed between the recording layer and the supporting substrate.

Since the index of refraction of low molecular weight organic materials used as the main ingredient of the recording layer is from 1.4 to 1.6 and quite different from that of air (1.0), light is reflected at the interface between the non-adhesion portion and the side face of the thermal recording layer. Thus, the air layer helps amplify the white opaqueness of the recording layer in the white opaque state, to thereby improve visibility. It is therefore desirable to use the non-adhesion portion as a displaying section.

Since the non-adhesion portion, which contains air therewithin, serves as a heat insulating layer, the heat sensitivity of the recording medium is improved. In addition, the non-adhesion portion serves as a cushion, since the pressure affecting the recording layer caused by a thermal printhead is lowered. The recording layer may therefore be prevented from deforming, and the particles of the low molecular weight organic materials are also prevented from expanding by heat application. The durability in repeated use of the recording layer may thus be improved.

A layer of an adhesive may be provided on the backside of the supporting substrate to form a reversible thermosensitive recording label. The label sheet is applied to a body to be mounted such as a vinyl chloride card (i.e., credit card), an IC card, an ID card, a paper, a film, a synthetic paper, a boarding card or a commuting ticket. The body to be mounted is not limited to the above specific examples. When the supporting substrate is made of a material such as, for example, an aluminum layer which is insufficient for adhesion to the resin, an adhesive layer may be interposed between the supporting substrate and the thermosensitive layer (JPA-3-7377).

The methods of forming and erasing an image according to the present invention are as follows.

There is one image forming and erasing method in which a common heating element such as, for example, a thermal printhead is used as image forming and erasing means. In this case, a different energy input is applied to the heating element for each of the recording and the erasing processes. In another method, in contrast, a thermal printhead is used as the image forming means, while contact and pressing type means is used as the image erasing means, such as a thermal printhead, a ceramic heater, a hot stamp, a heat roller or a heat block, or non-contact type means, such as hot air or infrared radiation is used.

Although the present invention is described hereinabove primarily relating to the occurrence of (1) cracks on the surface of an overcoat layer, which are enhanced by the application of heating pulses for shorter periods of time and/or the application of increased pressures during repeated image formation and erasure processing with a thermal printhead; and (2) portions of the overcoat layer being removed therefrom and then sticking to heating elements of the thermal printhead, caused by repeated application of mechanical stress during imaging processes, the invention is not limited to these applications but may also be applicable to obviate other similar difficulties.

Having generally described preferred embodiments, a further understanding can be obtained by reference to certain specific examples which are provided herein for purposes of illustration only and are not intended to be limiting. In the description in the following examples, parts and percentages are by weight unless otherwise indicated.

EXAMPLES

Example 1

A reversible thermosensitive recording medium of the present invention was fabricated according to the following steps and apparatus.

A layer of aluminum was deposited using a vacuum evaporation apparatus to form a light reflecting layer onto a supporting substrate of a transparent polyethylene terephthalate (PET) film (188 μm thick) having a thickness of about 400 A.

A mixture of the following components was prepared to obtain a coating composition for forming an adhesive layer.

| | |
|---|---|
| Vinyl chloride-vinyl acetate-phosphoric ester copolymer (Denka-vinyl #1000 P from Denki Kagaku Kogyo Co) | 5 parts |
| Tetrahydrofuran | 95 parts |

The coating composition thus prepared was coated on the light reflecting layer with a wire bar, and dried to form an adhesive layer having a thickness of 0.5 μm.

A coating composition for forming a thermosensitive recording layer was prepared by mixing the following components.

| | |
|---|---|
| 1,18-octadeca-dicarboxylic acid dodecyl (Miyoshi Oil and Fat Co.) | 4.75 parts |
| Eicosanedioic acid (SL-20-99 from Okamura Oil Co) | 5.25 parts |
| Vinyl chloride-vinyl acetate copolymer (M2018 from Kaneka Co.) | 28 parts |
| Dipenta-erythritol hexa-acrylate ε-caprlolacton adduct (DPCA-120 from Nihon Kayaku Co) | 2.37 parts |
| DPCA-60 (Nihon Kayaku Co) | 4.73 parts |
| Tetrahydrofuran | 215.5 parts |
| Amyl alcohol | 24 parts |
| Dibuthyltin laurate stabilizer (Stann | |

The thus prepared coating composition was coated on the adhesive layer with a wire bar, and dried to form a thermosensitive recording layer having a thickness of 10 μm.

The recording layer prepared as above was subsequently irradiated with an electron beam with an area-beam type electron beam irradiation apparatus EBC-200-AA2 from Nisshin High Voltage Inc. The electron beam irradiation was carried out to a resultant dosage of 10 Mrad.

In order to obtain a coating composition for forming a overcoat layer, a mixture of the following components was prepared.

| | |
|---|---|
| UV hardening resin containing photo-polymerization initiator (Deso-light Z7010V1 from JSR KK) | 100 parts |
| Talc LMS-300 (from Fuji Talc KK) | 0.2 part |
| Isopropyl alcohol | 100 parts. |

The thus prepared coating composition was coated with a wire bar on the recording layer, dried, and irradiated with ultraviolet radiation of about 450 mJ/cm$^2$ to form an overcoat layer having a thickness of 4 μm, whereby a reversible thermosensitive recording medium was fabricated.

In addition, the coating composition for forming the overcoat layer was coated separately on a glass plate, dried, and then irradiated with ultraviolet radiation in a similar manner as above, whereby a film was formed for use in the measurement of dynamic thermo-mechanical characteristics.

A test piece was subsequently obtained out of the thus prepared film of 36 mm in length and 3 mm in width. The test piece was subjected to dynamic heating measurements with a viscoelasticity spectrometer, RHEOVIBRON Model DDV-01FP (from ORIENTIC Inc.), in air under applied vibrations at a frequency of 10 Hz at a temperature increasing at a rate of 3° C./min, to thereby obtain (1) the dynamic modulus of elasticity G', (2) the dynamic elastic loss G", and (3) the loss tangent or tan δ which is defined by G'/G"=1/

($\omega\tau$), $\tau$ being the time required to reach the maximum tan $\delta$ value under a stress having an angular frequency $\omega$ continuously applied to the test piece.

Figure 3:
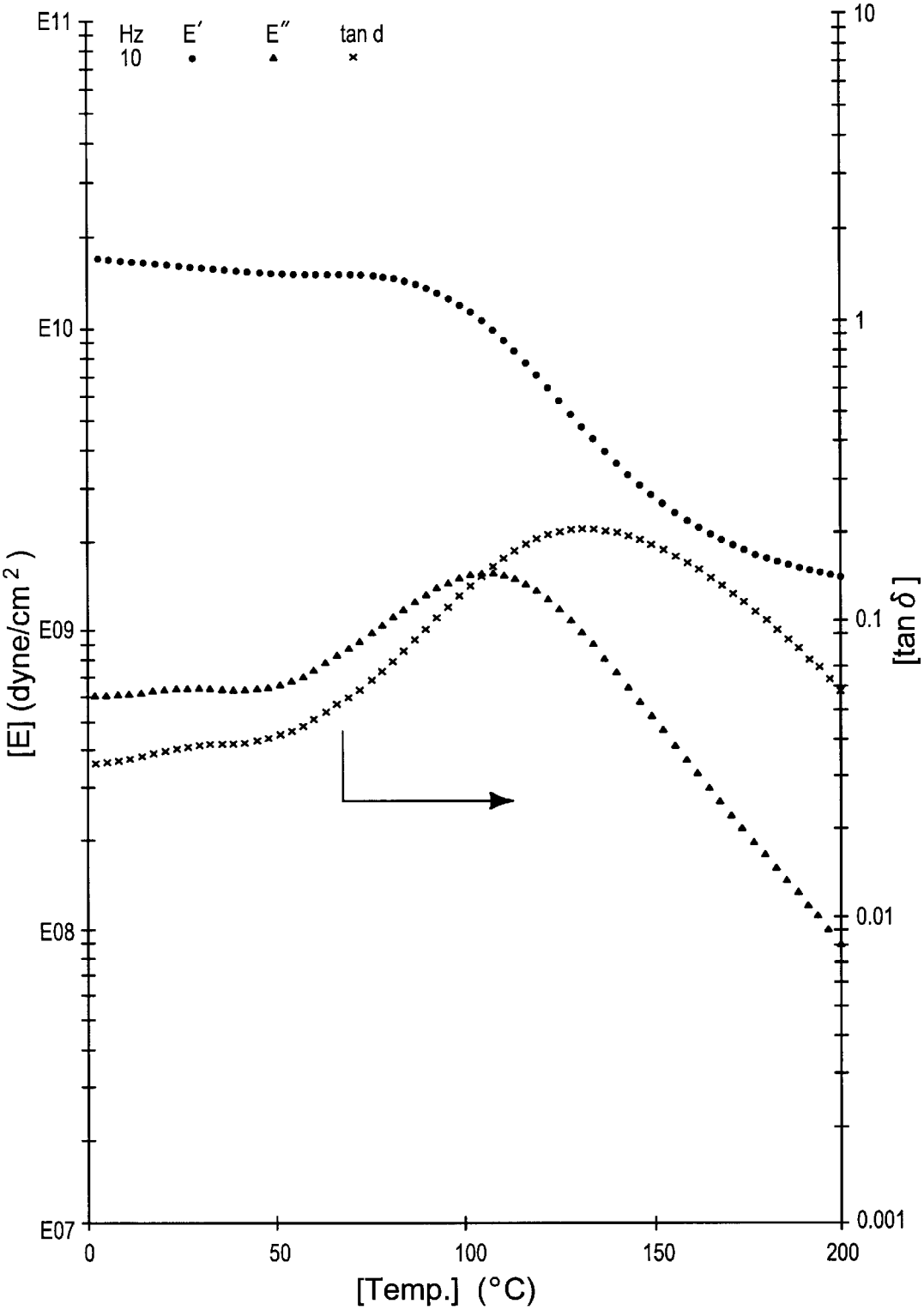
FIG. 3 shows a plot of the results from dynamic heating measurements as a tan δ vs. temperature curve for an overcoat layer of a reversible thermosensitive recording medium according to an embodiment of the present invention.

From the measurements, a tan $\delta$ vs. temperature curve was obtained with a peak temperature of about 131° C., and the results are shown in FIG. 3. Also included in FIG. 3 are curves of (1) the reserve modulus of elasticity E' vs. temperature, and (2) the elastic loss E" vs. temperature, both of which are observed during the measurements.

Example 2

Figure 4:
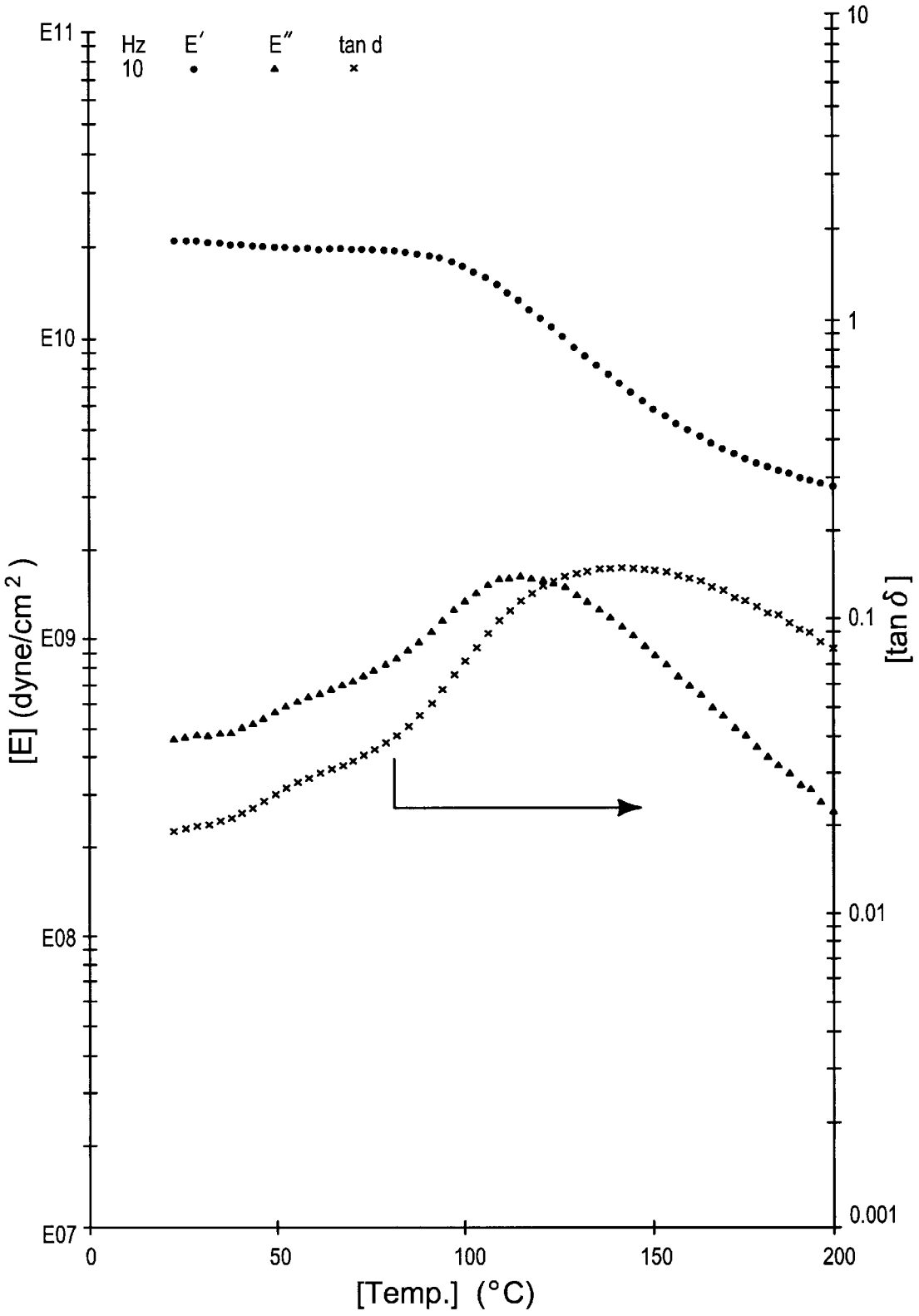
FIG. 4 shows a plot of the results from dynamic heating measurements as a tan δ vs. temperature curve of an overcoat layer of a reversible thermosensitive recording medium according to another embodiment of the present invention.

A reversible thermosensitive recording medium and a test piece for dynamic heating measurements were fabricated in a manner similar to Example 1, with the exception that a photo-polymerization initiator, Deso-light Z7010V2 (from JSR KK), was used for forming the overcoat in place of Deso-light Z7010V1 used in Example 1. The thus formed test piece was subsequently subjected to dynamic heating measurements in a manner similar to Example 1. From the measurements, a tan $\delta$ vs. temperature curve was obtained with a peak temperature of about 143° C., and the results are shown in FIG. 4.

Example 3

A reversible thermosensitive recording medium and a test piece for dynamic heating measurements were fabricated in a manner similar to Example 1, with the exception that a photo-polymerization initiator, Deso-light Z7010V9 (from JSR KK), was used for forming the overcoat in place of Deso-light Z7010V1 used in Example 1. The thus formed test piece was subsequently subjected to dynamic heating measurements in a manner similar to Example 1. From the measurements, a tan $\delta$ vs. temperature curve was obtained and a peak temperature of the curve was found to be about 153° C.

Example 4

A reversible thermosensitive recording medium and a test piece for dynamic heating measurements were fabricated in a manner similar to Example 1, with the exception that a photo-polymerization initiator, Deso-light Z7010W1 (from JSR KK), was used for forming the overcoat in place of Deso-light Z7010V1 used in Example 1. The thus formed test piece was subsequently subjected to dynamic heating measurements in a manner similar to Example 1. From the measurements, a tan $\delta$ vs. temperature curve was obtained and a peak temperature of the curve was found to be about 124° C.

Example 5

Figure 5:
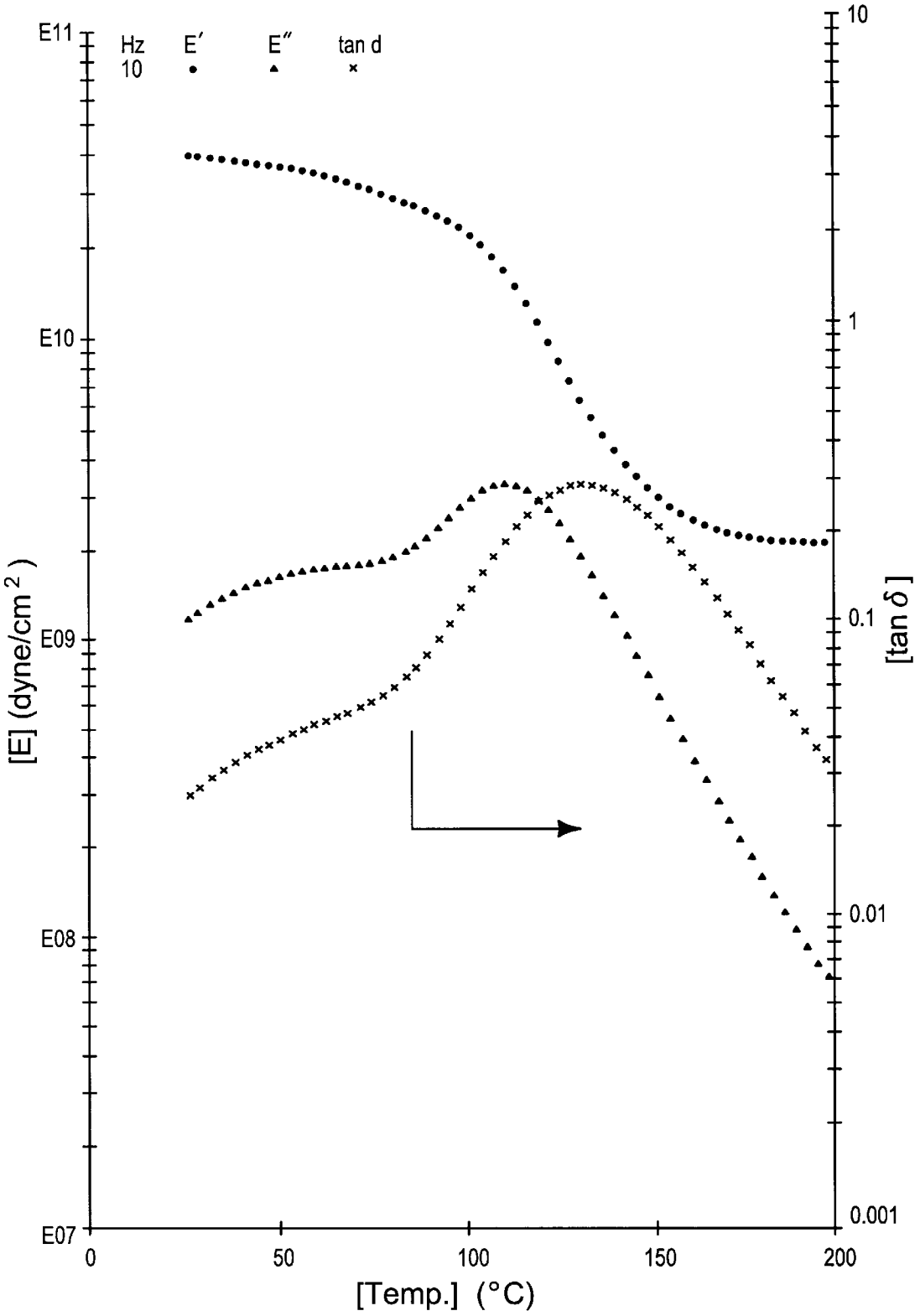
FIG. 5 shows a plot of the results from dynamic heating measurements as a tan δ vs. temperature curve of an overcoat layer of a reversible thermosensitive recording medium according to still another embodiment of the invention.

A reversible thermosensitive recording medium and a test piece for dynamic heating measurements were fabricated in a manner similar to Example 1, with the exception that a photo-polymerization initiator, Deso-light Z7010W2 (from JSR KK), was used for forming the overcoat in place of Deso-light Z7010V1 used in Example 1. The thus formed test piece was subsequently subjected to dynamic heating measurements in a manner similar to Example 1. From the measurements, a tan $\delta$ vs. temperature curve was obtained with a peak temperature of about 131° C., and the results are shown in FIG. 5.

Example 6

A reversible thermosensitive recording medium and a test piece for dynamic heating measurements were fabricated in a manner similar to Example 1, with the exception that a photo-polymerization initiator, Deso-light Z7010W4 (from JSR KK), was used for forming the overcoat in place of Deso-light Z7010V1 used in Example 1. The thus formed test piece was subsequently subjected to dynamic heating measurements in a manner similar to Example 1. From the measurements, a tan $\delta$ vs. temperature curve was obtained and a peak temperature of the curve was found to be about 147° C.

Example 7

A reversible thermosensitive recording medium and a test piece for dynamic heating measurements were fabricated in a manner similar to Example 1, with the exception that a photo-polymerization initiator, Deso-light Z7010V11 (from JSR KK), was used for forming the overcoat in place of Deso-light Z7010V1 used in Example 1. The thus formed test piece was subsequently subjected to dynamic heating measurements in a manner similar to Example 1. From the measurements, a tan $\delta$ vs. temperature curve was obtained and a peak temperature of the curve was found to be about 153° C.

Example 8

A reversible thermosensitive recording medium and a test piece for dynamic heating measurements were fabricated in a manner similar to Example 1, with the exception that a photo-polymerization initiator, Deso-light Z7010V12 (from JSR KK), was used for forming the overcoat in place of Deso-light Z7010V1 used in Example 1. The thus formed test piece was subsequently subjected to dynamic heating measurements in a manner similar to Example 1. From the measurements, a tan $\delta$ vs. temperature curve was obtained and a peak temperature of the curve was found to be about 148° C.

Example 9

A reversible thermosensitive recording medium and a test piece for dynamic heating measurements were fabricated in a manner similar to Example 1, with the exception that a photo-polymerization initiator, Deso-light Z7010V14 (from JSR KK), was used for forming the overcoat in place of Deso-light Z7010V1 used in Example 1. The thus formed test piece was subsequently subjected to dynamic heating measurements in a manner similar to Example 1. From the measurements, a tan $\delta$ vs. temperature curve was obtained and a peak temperature of the curve was found to be about 150° C.

Example 10

In order to fabricate a reversible thermosensitive recording medium of the present invention, a layer of aluminum which was disposed on a supporting substrate as a light reflecting layer, an adhesive layer, and a thermosensitive recording layer, were formed, in the order recited, in a manner similar to Example 1.

Subsequently, a coating composition for the first overcoat layer was prepared by mixing the following components.

| | |
|---|---|
| UV hardening resin containing photo-polymerization initiator (Deso-light Z7010V14 from JSR KK) | 100 parts |
| Isopropyl alcohol | 100 parts. |

The thus prepared coating composition was coated using a wire bar on the recording layer, dried at 90° C. for 1 minute, and irradiated with ultraviolet radiation of about 450 mJ/cm$^2$, thereby forming the first overcoat layer having a thickness of about 2.5 μm.

In addition, the second overcoat layer, having a thickness of about 1.5 μm, was formed on the thus formed first overcoat layer by (1) disposing a layer of ink composed of a UV hardening resin containing a photo-polymerization initiator Deso-light KZ7669 (from JSR KK) by the offset printing method, and (2) hardening by irradiating with a 120 W/cm$^2$ ultraviolet lamp, whereby a reversible thermosensitive recording medium of the present invention was fabricated.

Further, the above-mentioned ink for forming the second overcoat layer was disposed separately on a glass plate with an applicator, dried, and then irradiated with ultraviolet radiation in a similar manner as above, whereby a film was formed for use in the measurements of dynamic thermomechanical characteristics.

A test piece was subsequently obtained out of the thus prepared film of 36 mm in length and 3 mm in width. This test piece was subjected to dynamic heating measurements in a manner similar to Example 1. From the measurements, a tan δ vs. temperature curve was obtained and a peak temperature of the curve was found to be about 124° C.

Example 11

Figure 6:
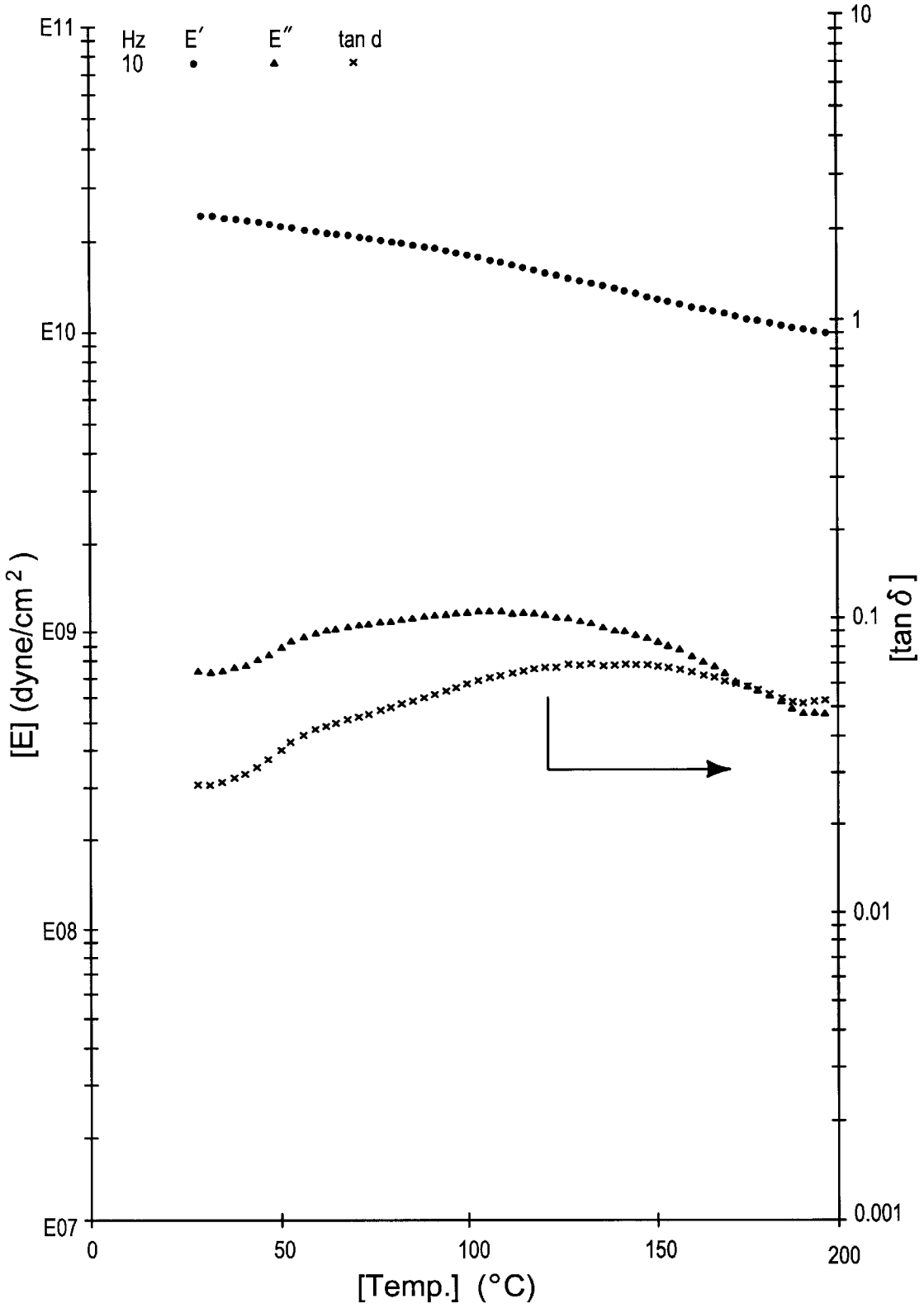
FIG. 6 shows a plot of the results from dynamic heating measurements as a tan δ vs. temperature curve of an overcoat layer of a reversible thermosensitive recording medium according to another embodiment of the present invention.

A reversible thermosensitive recording medium and a test piece for dynamic heating measurements were fabricated in a manner similar to Example 10, with the exception that a photo-polymerization initiator, Deso-light KZ7670 (from JSR KK), was used in place of Deso-light KZ7669 which was used in Example 10 for forming the second overcoat overlying the first overcoat layer as aforementioned. The thus formed test piece was subsequently subjected to dynamic heating measurements in a manner similar to Example 1. From the measurements, a tan δ vs. temperature curve was obtained with a peak temperature of about 134° C., and the results are shown in FIG. 6.

Example 12

A reversible thermosensitive recording medium and a test piece for dynamic heating measurements were fabricated in a manner similar to Example 10, with the exception that a photo-polymerization initiator, Deso-light KZ7671 (from JSR KK), was used in place of Deso-light KZ7669 which was used in Example 10 for forming the second overcoat overlying the first overcoat layer as aforementioned. The thus formed test piece was subsequently subjected to dynamic heating measurements in a manner similar to Example 1. From the measurements, a tan δ vs. temperature curve was obtained and a peak temperature of the curve was found to be about 146° C.

Example 13

In order to fabricate a reversible thermosensitive recording medium of the present invention, a layer of aluminum as a light reflecting layer on a supporting substrate, an adhesive layer, and a thermosensitive recording layer were formed, in the order recited, in a manner similar to Example 1.

In addition, a overcoat layer having a thickness of about 4.0 μm was formed on the thus formed thermosensitive recording layer by (1) disposing a layer of ink composed of a UV hardening resin containing a photo-polymerization initiator Deso-light KZ7670 (from JSR KK) by the offset printing method, and (2) hardening by irradiating with a 120 W/cm$^2$ ultraviolet lamp, whereby a reversible thermosensitive recording medium of the present invention was fabricated.

In addition, the above-mentioned ink for forming the overcoat layer was disposed separately on a glass plate with an applicator, dried, and then irradiated with ultraviolet radiation in a similar manner as above, whereby a film was formed for use in the measurements of dynamic thermomechanical characteristics.

A test piece was subsequently obtained out of the thus prepared film of 36 mm in length and 3 mm in width. This test piece was subjected to dynamic heating measurements in a manner similar to Example 1. From the measurements, a tan δ vs. temperature curve was obtained and a peak temperature of the curve was found to be about 134° C.

Example 14

A reversible thermosensitive recording medium and a test piece for dynamic heating measurements were fabricated in a manner similar to Example 10, with the exception that a photo-polymerization initiator, Deso-light KZ7696 (from JSR KK), was used in place of Deso-light KZ7669 which was used in Example 10 for forming the second overcoat overlying the first overcoat layer as aforementioned. The thus formed test piece was subsequently subjected to dynamic heating measurements in a manner similar to Example 1. From the measurements, a tan δ vs. temperature curve was obtained and a peak temperature of the curve was found to be about 148° C.

Example 15

A reversible thermosensitive recording medium of the present invention was fabricated in accordance with steps and apparatus which follow.

A white polyester film U29-250 (from Teijin KK) was used as a supporting substrate, which had a thickness of about 250 μm and was surface treated in solutions of PH 4–6.

The following components were first pulverized into fine particles having a diameter of from about 0.1 to about 1 μm with a ball mill.

| | |
|---|---|
| 2-Anilino-3-methyl-6-diethylaminofluorene Coloring agent | 2 parts |
| 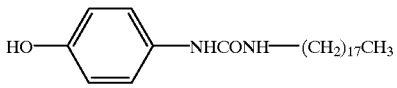 | 8 parts |

A dispersion was then prepared using the thus prepared particles in 150 parts of a 15% tetahydrofuran solution of thermosetting resin LR503 (from Mitsubishi Rayon Inc.). A coating composition for forming a thermosensitive recording layer was subsequently prepared by mixing thoroughly parts of a 75% ethylacetate solution of an adduct-type hexamethylene isocyanate (Coronate HL from Japan Urethane KK) with the dispersion prepared as above.

The thus prepared coating composition was coated on the supporting substrate using a wire bar, dried at 100° C. for 1 minute, and hardened through heating at 60° C. for 24 hours, whereby a thermosensitive recording layer was fabricated having a thickness of about 8 μm.

Subsequently, a coating composition for forming an intermediate layer was prepared by mixing the following compositions.

| | |
|---|---|
| Zinc oxide (ZS303 from Sumitomo Cement Co.) | 4 parts |
| Thermosetting resin (LR503 from Mitsubishi Rayon Co.) | 2 parts |
| Coronate HL (from Japan Urethane KK) | 0.5 part |
| Methyl ethyl ketone | 4 parts |

The thus prepared coating composition was coated on the thermosensitive recording layer with a wire bar, and dried at 100° C. to form the intermediate layer having a thickness of about 1.5 μm.

To obtain a coating composition for a overcoat layer, a mixture of the following components was prepared.

| | |
|---|---|
| UV hardening resin containing photo-polymerization initiator (Deso-light Z7010V14 from JSR KK) | 100 parts |
| Talc (LMS-300 from Fuji Talc KK) | 0.2 part |
| Isopropyl alcohol | 100 parts. |

The thus prepared coating composition was coated with a wire bar on the intermediate layer, dried at 60° C. for 24 hours, and irradiated with ultraviolet radiation of about 450 mJ/cm$^2$ to form an overcoat layer having a thickness of about 4 μm, whereby a reversible thermosensitive recording medium was fabricated.

In addition, using the coating composition for forming the above overcoat layer, a film and a test piece therefrom were formed in a manner similar to Example 1 for use in the measurements of dynamic thermo-mechanical characteristics.

The thus formed test piece was subsequently subjected to dynamic heating measurements in a manner similar to Example 1. From the meassurements, a tan δ vs. temperature curve was obtained and a peak temperature of the curve was found to be about 150° C.

Example 16

A reversible thermosensitive recording medium was fabricated in a manner similar to Example 15, with the exception that the first and second overcoat layers were formed in a manner similar to Example 11, in place of the single overcoat layer of Example 15.

In addition, a film and a test piece therefrom were formed using the aforementioned ink for forming the second overcoat layer in a manner similar to Example 11, for use in the measurements of dynamic thermo-mechanical characteristics. The thus formed test piece was subjected to dynamic heating measurements in a manner similar to Example 1. From the measurements, a tan δ vs. temperature curve was obtained and a peak temperature of the curve was found to be about 134° C.

Comparative Example 1

In order to fabricate a reversible thermosensitive recording medium of the present invention, a layer of aluminum, which was formed on a supporting substrate as a light reflecting layer, an adhesive layer, and a thermosensitive recording layer, were formed in the order recited, in a similar manner to Example 1.

A coating composition for forming an overcoat layer was then prepared by mixing the following components.

| | |
|---|---|
| UV hardening urethane acrylate resin containing photo-polymerization initiator Bs575CS-B (from Arakawa Kagaku KK) | 100 parts |
| Calcium carbonate Brilliant 15 (from Shiraishi Kogyo KK) | 0.8 part |
| Isopropyl alcohol | 200 parts. |

The thus prepared coating composition was coated with a wire bar on the recording layer, dried at 90° C. for 1 minute, and irradiated with ultraviolet radiation of about 450 mJ/cm$^2$ to form an overcoat layer having a thickness of about 4 μm, whereby a reversible thermosensitive recording medium was fabricated.

In addition, the coating composition for the overcoat layer prepared as above was coated separately on a glass plate, dried and then irradiated with ultraviolet radiation in a similar manner as above, whereby a film was formed for use in the measurements of dynamic thermo-mechanical characteristics.

A test piece of 36 mm in length and 3 mm in width was subsequently obtained out of the thus prepared film. This test piece was subjected to dynamic heating measurements in a manner similar to Example 1. From the measurements, a tan δ vs. temperature curve was obtained and a peak temperature of the curve was found to be about 260° C.

Comparative Example 2

A reversible thermosensitive recording medium and a test piece for dynamic heating measurements were fabricated in a similar manner to Comparative Example 1, with the exception that a coating composition for forming an overcoat was prepared by mixing the following components.

| | |
|---|---|
| Penta-erythritol triacrylate KAYARAD PET-30 (from Nihon Kayaku K.K.) | 15 parts |
| Penta-erythritol triacrylate ARONIX M-450 (from Toa Gosei K.K.) | 15 parts |
| Dipenta-erythritol hexa-acrylate (KAYARAD DPHA from Nihon Kayaku K.K.) | 20 parts |
| Di(acryloxyethyl) isocyanulate ARONIX M-400 (from Toa Gosei K.K.) | 25 parts |
| Tris(acryloxyethyl) isocyanulate ARONIX M-315 (from Toa Gosei K.K.) | 25 parts |
| 1-Hydroxycyclohexyl phenyl ketone | 2 parts |
| Calcium carbonate Brilliant 15 (from Shiraishi Kogyo KK) | 0.6 part |
| Butyl acetate | 30 parts |
| Isopropyl alcohol | 70 parts. |

The test piece was subsequently subjected to dynamic heating measurements in a similar manner to Example 1. From the measurements, a tan δ vs. temperature curve was obtained and a peak temperature of the curve was found to be about 300° C.

Comparative Example 3

A reversible thermosensitive recording medium and a test piece for dynamic heating measurements were fabricated in a manner similar to Comparative Example 1, with the exception that a coating composition for forming an overcoat was prepared by mixing the following components.

| | |
|---|---|
| UV hardening urethane acrylate resin C3-599 (from Nihon Ink Co.) | 80 parts |
| Calcium carbonate Brilliant 15 (from Shiraishi Kogyo KK) | 0.8 part |
| Isopropyl alcohol | 48 parts. |

The test piece was subsequently subjected to dynamic heating measurements in a manner similar to Example 1. From the measurements, a tan δ vs. temperature curve was obtained and a peak temperature of the curve was found to be about 200° C.

Comparative Example 4

A reversible thermosensitive recording medium and a test piece for dynamic heating measurements were fabricated in a manner similar to Comparative Example 1, with the exception that a coating composition for forming an overcoat was prepared by mixing the following components.

| | |
|---|---|
| Penta-erythritol triacrylate ARONIX N-450 (from Toa Gosei K.K.) | 50 parts |
| Hydroxypyruvic ester neopentyl glycol diacrylate KAYARAD MANDA (from Nihon Kayaku K.K.) | 25 parts |
| Neopetyl glycol di-acrylate (KAYARAD NPGDA from Nihon Kayaku K.K.) | 25 parts |
| Calcium carbonate Brilliant 15 (from Shiraishi Kogyo KK) | 0.6 part |
| 1-Hydroxycyclohexyl phenyl ketone | 2 parts |
| Isopropyl alcohol | 100 parts. |

The test piece was subsequently subjected to dynamic heating measurements in a manner similar to Example 1. From the measurements, a tan δ vs. temperature curve was obtained and a peak temperature of the curve was found to be about 160° C.

Comparative Example 5

A reversible thermosensitive recording medium and a test piece for dynamic heating measurements were fabricated in a manner similar to Example 15, with the exception that the overcoat layer was formed in manner similar to Comparative Example 1, in place of the overcoat layer of Example 15.

The thus formed test piece was subjected to dynamic heating measurements in a manner similar to Example 1. From the measurements, a tan δ vs. temperature curve was obtained and a peak temperature of the curve was found to be about 260° C.

A plurality of reversible thermosensitive recording media fabricated in these Examples and Comparative Examples were subjected to several measurements such as the (1) the arithmetic mean deviation of profile (Ra), (2) the number of peaks (Pc) in standard surface area, and (3) coefficient of friction, each of which was measured for respective recording media with the aforementioned measurement method. The results obtained from the measurements are summarized in Table 1.

TABLE 1

| | Tan δ peak temperature or related characteristic relaxation temperature (° C.) | Coloring temperature of thermosensitive layer (° C.) | Arithmetic mean deviation of profile (Ra) | Number of peaks per standard area (Pc) | Coefficient of friction |
|---|---|---|---|---|---|
| Ex. 1 | Approx. 131 | 118 | 0.19 | 11–50 | 0.08 |
| Ex. 2 | Approx. 143 | 120 | 0.21 | 11–50 | 0.07 |
| Ex. 3 | Approx. 153 | 122 | 0.18 | 11–50 | 0.07 |
| Ex. 4 | Approx. 124 | 118 | 0.20 | 11–50 | 0.08 |
| Ex. 5 | Approx. 131 | 120 | 0.20 | 11–50 | 0.08 |
| Ex. 6 | Approx. 147 | 120 | 0.19 | 11–50 | 0.07 |
| Ex. 7 | Approx. 153 | 122 | 0.19 | 11–50 | 0.08 |
| Ex. 8 | Approx. 148 | 122 | 0.20 | 11–50 | 0.08 |
| Ex. 9 | Approx. 150 | 122 | 0.18 | 11–50 | 0.08 |
| Ex.10 | Approx. 124 | 118 | 0.27 | 101–300 | 0.04 |
| Ex.11 | Approx. 134 | 118 | 0.31 | 101–300 | 0.05 |
| Ex.12 | Approx. 146 | 120 | 0.27 | 101–300 | 0.04 |
| Ex.13 | Approx. 134 | 118 | 0.30 | 101–300 | 0.05 |
| Ex.14 | Approx. 148 | 120 | 0.32 | 101–300 | 0.04 |
| Ex.15 | Approx. 150 | 172 | 0.18 | 11–50 | 0.08 |
| Ex.16 | Approx. 134 | 170 | 0.31 | 101–300 | 0.05 |
| Comp. Ex.1 | Approx. 260 | 122 | 0.31 | 11–50 | 0.07 |
| Comp. Ex.2 | Approx. 300 | 122 | 0.27 | 11–50 | 0.08 |
| Comp. Ex.3 | Approx. 200 | 120 | 0.29 | 11–50 | 0.08 |
| Comp. Ex.4 | Approx. 160 | 120 | 0.30 | 11–50 | 0.08 |
| Comp. Ex.5 | Approx. 260 | 170 | 0.31 | 11–50 | 0.07 |

Method of Coloring Temperature Measurement for Thermosensitive Recording Layer

Measurements of coloring temperature of a plurality of thermosensitive recording layers fabricated as above were carrried out as follows.

Namely, the measurements were made with a heat gradation tester HG-100 from Toyo-Seiki Seisakusho Co. under conditions which include a printing time of 1 second set in a printing timer of the tester and a printing pressure of 1 kg/cm$^2$ as indicated on a pressure gauge. Under the above conditions, each thermosensitive layer in an erased state was heated for image formation from 100° C. at a rate of temperature increase of 2° C. per minute, then cooled to room temperature and subsequently subjected to reflection density measurements with a MacBeth RD-914 densitomer.

The coloring temperature was deduced by obtaining a temperature as the saturated colored temperature such that the difference in color density between that temperature and a temperature 2° C. lower than that temperature was within 0.03. The results obtained from the measurements are included in Table 1.

In addition, repetitive imaging/erasure tests were carried out for the plurality of reversible thermosensitive recording media using the following method.

Method of Repetitive Imaging/Erasure Tests

With a magnetic card reader/writer equipped with an erasure auxiliary equipment KU-R3001FA (from Kyushu Matsushita Electric Co.), imaging/erasure tests were repeated for 500 times under the conditions (1) for reversible thermosensitive recording media prepared in Examples 1 through 14 and Comparative Examples 1 through 4 at a printing energy of 0.47 mJ/dot applied by a thermal printhead and an erasure temperature of a ceramic heater of 91° C., and (2) for recording media prepared in Examples 15 and 16 and Comparative Example at a printing energy of 0.7 mJ/dot and a erasure temperature of the ceramic heater of 150° C.

After every 100 times of repetition, the samples were examined for any change or increase regarding cracks and peeling on the recording layer and dirt accumulated on the printhead. The results from the observation are summarized in Table 2 with the following notations.

Cracks Appeared:
- 5: observed none
- 4: only few
- 3: some
- 2: some more
- 1: observed considerably Sticking Appeared:
- 5: observed none
- 4: only few
- 3: some
- 2: some more
- 1: observed considerably Furthermore, optical density values were measured with a MacBeth Reflective Densitometer (Model RD-914) at the same portion of the media after the first imaging test and after 500 repeated test cycles. The results from the masurements are shown in Table 3.

TABLE 2

| | Cracks | | | | | Sticking | | | | |
|---|---|---|---|---|---|---|---|---|---|---|
| | 100 | 200 | 300 | 400 | 500 | 100 | 200 | 300 | 400 | 500 |
| Ex. 1 | 5 | 5 | 5 | 5 | 5 | 5 | 5 | 5 | 5 | 5 |
| Ex. 2 | 5 | 5 | 5 | 5 | 5 | 5 | 5 | 5 | 5 | 5 |
| Ex. 3 | 5 | 5 | 5 | 5 | 4 | 5 | 5 | 5 | 5 | 4 |
| Ex. 4 | 5 | 5 | 5 | 5 | 5 | 5 | 5 | 5 | 5 | 5 |
| Ex. 5 | 5 | 5 | 5 | 5 | 5 | 5 | 5 | 5 | 5 | 5 |
| Ex. 6 | 5 | 5 | 5 | 5 | 4 | 5 | 5 | 5 | 5 | 4 |
| Ex. 7 | 5 | 5 | 5 | 5 | 4 | 5 | 5 | 5 | 5 | 4 |
| Ex. 8 | 5 | 5 | 5 | 5 | 4 | 5 | 5 | 5 | 5 | 4 |
| Ex. 9 | 5 | 5 | 5 | 5 | 4 | 5 | 5 | 5 | 5 | 4 |
| Ex. 10 | 5 | 5 | 5 | 5 | 5 | 5 | 5 | 5 | 5 | 5 |
| Ex. 11 | 5 | 5 | 5 | 5 | 5 | 5 | 5 | 5 | 5 | 5 |
| Ex. 12 | 5 | 5 | 5 | 5 | 4 | 5 | 5 | 5 | 5 | 4 |
| Ex. 13 | 5 | 5 | 5 | 5 | 5 | 5 | 5 | 5 | 5 | 5 |
| Ex. 14 | 5 | 5 | 5 | 5 | 4 | 5 | 5 | 5 | 5 | 4 |
| Ex. 15 | 5 | 5 | 5 | 5 | 4 | 5 | 5 | 5 | 5 | 4 |
| Ex. 16 | 5 | 5 | 5 | 5 | 5 | 5 | 5 | 5 | 5 | 5 |
| Comp. Ex. 1 | 5 | 4 | 3 | 2 | 2 | 5 | 4 | 3 | 3 | 2 |
| Comp. Ex. 2 | 5 | 4 | 3 | 2 | 1 | 5 | 4 | 3 | 2 | 1 |
| Comp. Ex. 3 | 5 | 5 | 4 | 3 | 2 | 5 | 5 | 4 | 3 | 2 |
| Comp. Ex. 4 | 5 | 5 | 4 | 3 | 3 | 5 | 5 | 4 | 3 | 3 |
| Comp. Ex. 5 | 5 | 4 | 3 | 2 | 2 | 5 | 4 | 3 | 3 | 2 |

TABLE 3

| | Initial optical density | | Optical density, after 500 cycles | |
|---|---|---|---|---|
| | image formed | image erased | image formed | image erased |
| Ex. 1 | 0.23 | 1.09 | 0.30 | 1.13 |
| Ex. 2 | 0.24 | 1.08 | 0.30 | 1.12 |
| Ex. 3 | 0.24 | 1.08 | 0.30 | 1.13 |
| Ex. 4 | 0.25 | 1.08 | 0.29 | 1.11 |
| Ex. 5 | 0.23 | 1.09 | 0.28 | 1.14 |
| Ex. 6 | 0.23 | 1.07 | 0.28 | 1.10 |
| Ex. 7 | 0.24 | 1.07 | 0.30 | 1.10 |
| Ex. 8 | 0.23 | 1.08 | 0.30 | 1.12 |

TABLE 3-continued

| | Initial optical density | | Optical density, after 500 cycles | |
|---|---|---|---|---|
| | image formed | image erased | image formed | image erased |
| Ex. 9 | 0.23 | 1.08 | 0.29 | 1.12 |
| Ex.10 | 0.24 | 1.00 | 0.28 | 1.03 |
| Ex.11 | 0.25 | 1.02 | 0.29 | 1.04 |
| Ex.12 | 0.24 | 1.00 | 0.27 | 1.02 |
| Ex.13 | 0.25 | 1.04 | 0.30 | 1.07 |
| Ex.14 | 0.23 | 1.03 | 0.29 | 1.05 |
| Ex.15 | 1.12 | 0.09 | 0.98 | 0.12 |
| Ex.16 | 1.10 | 1.10 | 0.97 | 0.13 |
| Comp. Ex.1 | 0.25 | 1.00 | 0.38 | 0.89 |
| Comp. Ex.2 | 0.25 | 1.01 | 0.35 | 0.85 |
| Comp. Ex.3 | 0.24 | 1.00 | 0.32 | 0.91 |
| Comp. Ex.4 | 0.23 | 1.02 | 8.32 | 0.92 |
| Comp. Ex.5 | 1.08 | 0.10 | 0.87 | 0.20 |

As will be apparent from the above description including the examples, a reversible thermosensitive recording medium is disclosed herein, which is capable of satisfactorily carrying out the erasure of recorded images with a heating device such as, for example, a thermal printhead, by overcoming the difficulties such as the occurrence of (1) cracks on the surface of an overcoat layer, enhanced by the application of heating pulses for shorter periods of time and/or at increased pressures during repeated processes of image formation and erasure with the thermal printhead, and (2) portions of the overcoat layer being removed therefrom and then sticking to heating elements of the thermal printhead, caused by repeated applications of mechanical stress during imaging processes. Therefore, a sufficient visibility and excellent quality of recorded images are achieved with the reversible thermosensitive recording medium of the present invention.

This document claims priority and contains subject matter related to Japanese Patent Application 10-092230 (1998), filed with the Japanese Patent Office on Mar. 23, 1998, the entire contents of which are hereby incorporated by reference.

Additional modifications and variations of the embodiments disclosed herein are possible in light of the above teachings. It is therefore to be understood that within the scope of the appended claims, these embodiments may be practiced otherwise than as specifically described herein.

What is claimed is:

1. A reversible thermosensitive recording medium comprising:

a supporting substrate;

a thermosensitive layer provided on said supporting substrate; and an overcoat layer provided over said thermosensitive layer, wherein said thermosensitive layer changes transparency or color tone reversibly with temperature, said overcoat layer has a temperature of at most a 155° C. for a peak temperature in a tan δ vs. temperature curve or a characteristic temperature of dynamic relaxation related to said peak temperature in said tan δ vs. temperature curve.

2. A reversible thermosensitive recording medium according to claim 1, wherein said overcoat layer has a temperature of at least 120° C. for said peak temperature of said tan δ vs. temperature curve or said characteristic temperature of dynamic relaxation related to said tan δ vs. temperature curve.

3. A reversible thermosensitive recording medium according to claim 1, wherein said overcoat layer comprises two kinds of compositional layers.

4. A reversible thermosensitive recording medium according to claim 1, wherein said overcoat layer has a rough surface with a number peaks (Pc) of at least 3 in a standard area.

5. A reversible thermosensitive recording medium according to claim 1, wherein a surface of said overcoat layer has a coefficient of friction of at most 0.10.

6. A reversible thermosensitive recording medium according to claim 1, wherein said overcoat layer includes a matrix resin which comprises one of a thermosetting resin composition, an ultraviolet hardening resin composition, and an electron beam hardening resin composition.

7. A reversible thermosensitive recording medium according to claim 1, wherein said overcoat layer includes a matrix resin which comprises a resin hardened by application of heat, irradiation by ultraviolet radiation, or electron beam irradiation.

8. A reversible thermosensitive recording medium according to claim 1, wherein said thermosensitive recording layer includes a matrix resin which comprises one of a thermosetting resin composition, an ultraviolet hardening resin composition, and an electron beam hardening resin composition.

9. A reversible thermosensitive recording medium according to claim 1, wherein said thermosensitive recording layer includes a matrix resin which comprises a resin hardened by either application of heat, irradiation by ultraviolet radiation, or electron beam irradiation.

10. A reversible thermosensitive recording medium according to claim 1, further comprising an information recording section.

11. A reversible thermosensitive recording medium according to claim 10, wherein said information recording section comprises one of a magnetic layer provided in a portion between said supporting substrate and said thermosensitive recording layer or in a portion of a side of said supporting substrate opposite said thermosensitive recording layer, and a magnetic stripe provided at least in a portion of a displaying surface of said recording medium.

12. A reversible thermosensitive recording medium according to claim 10, wherein said information recording section comprises one of integrated circuit memories and optical memories provided at least in a portion of said reversible thermosensitive recording medium.

13. A reversible thermosensitive recording medium according to claim 1, wherein said reversible thermosensitive recording medium comprises two kinds of compositional substrates that are laminated to each other.

14. A reversible thermosensitive recording medium according to claim 1, further comprising a color printed layer formed of a coloring agent and a resin binder and provided at least in a portion above said overcoat layer or on a side of said supporting substrate opposite to said recording layer.

15. A reversible thermosensitive recording medium according to claim 14, wherein said overcoat layer comprises first and a second compositional layers such that said second overcoat layer is provided on either said first overcoat layer overlying said recording layer or said color printed layer.

16. A reversible thermosensitive recording medium comprising:

a supporting substrate;

a thermosensitive layer provided on said supporting substrate; and an overcoat layer provided over said thermosensitive layer, wherein said thermosensitive layer changes transparency or color tone reversibly with temperature, said overcoat layer has a temperature which is at most 35° C. higher than a coloring temperature of said reversible thermosensitive recording layer for a peak temperature of a tan δ vs. temperature curve or a characteristic temperature of dynamic relaxation related to said peak temperature of said tan δ vs. temperature curve.

17. A reversible thermosensitive recording medium according to claim 16, wherein said overcoat layer has a temperature ranging between 120° and 155° C. for said peak temperature of said tan δ vs. temperature curve or said characteristic temperature of dynamic relaxation related to said tan δ vs. temperature curve.

18. A reversible thermosensitive recording medium according to claim 1, wherein said overcoat layer has an arithmetic mean deviation surface profile (Ra) of at least 0.05 μm.

19. A method of forming and erasing an image on a reversible thermosensitive recording medium, said reversible thermosensitive recording medium comprising a supporting substrate, a thermosensitive layer provided on said supporting substrate, and an overcoat layer provided over said thermosensitive layer, wherein said thermosensitive layer changes transparency or color tone reversibly with temperature, and said overcoat layer has a temperature of at most 155° C. for a peak temperature of a tan δ vs. temperature curve or a characteristic temperature of dynamic relaxation related to said tan δ vs. temperature curve, said method comprising the steps of:

heating said thermosensitive layer to form an image; and heating said thermosensitive layer to erase said image.

20. A method of forming and erasing an image on a reversible thermosensitive recording medium according to claim 19, wherein said heating is carried out with a thermal printhead.

21. A method of forming and erasing an image on a reversible thermosensitive recording medium according to claim 19, wherein said heating is carried out with at least one heating means selected from the group consisting essentially of a thermal printhead, a ceramic heater, a hot stamp, a heat roller, and a heat block.

22. A method of forming and erasing an image on a reversible thermosensitive recording medium, said reversible thermosensitive recording medium comprising a supporting substrate, a thermosensitive layer provided on said supporting substrate, and an overcoat layer provided over said thermosensitive layer, wherein said thermosensitive layer changes transparency or color tone reversibly with temperature, and said overcoat layer has a temperature at most 35° C. higher than a coloring temperature of said reversible thermosensitive recording layer for a peak temperature of a tan δ vs. temperature curve or a characteristic temperature of dynamic relaxation related to said tan δ vs. temperature curve, said method comprising the steps of:

heating said thermosensitive layer to form an image; and heating said thermosensitive layer to erase said image.

23. A method of forming and erasing an image on a reversible thermosensitive recording medium according to claim 22, wherein said heating is carried out with a thermal printhead.

24. A method of forming and erasing an image on a reversible thermosensitive recording medium according to claim 22, wherein said heating is carried out with at least one heating means selected from the group consisting essentially of a thermal printhead, a ceramic heater, a hot stamp, a heat roller and a heat block.

* * * * *